US012031311B2

(12) United States Patent
Tanimoto et al.

(10) Patent No.: US 12,031,311 B2
(45) Date of Patent: Jul. 9, 2024

(54) FLUSH WATER TANK DEVICE AND FLUSH TOILET APPARATUS PROVIDED WITH THE SAME

(71) Applicant: TOTO LTD., Kitakyushu (JP)

(72) Inventors: Hideki Tanimoto, Kitakyushu (JP); Koki Shinohara, Kitakyushu (JP); Kenji Hatama, Kitakyushu (JP); Seika Tatsuoka, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 97 days.

(21) Appl. No.: 17/822,592

(22) Filed: Aug. 26, 2022

(65) Prior Publication Data

US 2023/0065471 A1 Mar. 2, 2023

(30) Foreign Application Priority Data

Aug. 27, 2021 (JP) ..... 2021-139355

(51) Int. Cl.
*E03D 1/34* (2006.01)
*E03D 1/30* (2006.01)

(52) U.S. Cl.
CPC ..... *E03D 1/34* (2013.01); *E03D 1/304* (2013.01)

(58) Field of Classification Search
CPC .... E03D 1/34; E03D 1/35; E03D 1/30; E03D 1/32; E03D 1/33; E03D 1/10; E03D 1/025
See application file for complete search history.

(56) References Cited

U.S. PATENT DOCUMENTS 11,505,933 B2 * 11/2022 Kitaura ..... E03D 5/105

FOREIGN PATENT DOCUMENTS

JP H06-146365 A 5/1994

* cited by examiner

*Primary Examiner* — Erin Deery
(74) *Attorney, Agent, or Firm* — Studebaker & Brackett PC

(57) ABSTRACT

The present invention provides a flush water tank device (4), including: a flush water tank (10); a discharge valve (12) that causes the lower spout port to eject the flush water by switching between discharge and stopping of the flush water; a water pressure driving mechanism (14) that drives the discharge valve with a water supply pressure; a first on-off valve (19) that switches between water ejection and stopping of the flush water; a second on-off valve (18) that switches between water supply and stopping of the flush water to the water pressure driving mechanism; and a delay valve opening mechanism (21) that causes the second on-off valve to open with a delay of predetermined time after water ejection from the upper spout port is started, using a part of the flush water introduced via the first on-off valve, to supply the flush water to the water pressure driving mechanism.

7 Claims, 15 Drawing Sheets

FLUSH WATER TANK DEVICE AND FLUSH TOILET APPARATUS PROVIDED WITH THE SAME

BACKGROUND OF THE INVENTION

Field of the Invention

The present invention relates to a flush water tank device and particularly to a flush water tank device for supplying flush water to an upper spout port above a retained water surface in a flush toilet main body and a lower spout port below the retained water surface and a flush toilet apparatus provided with the same.

Description of the Related Art

Japanese Patent Laid-Open No. 6-146365 (Patent Document 1) describes a toilet washing tank device. According to the toilet washing tank device, a lever member is pressed down through rotation of a lever handle, and as a result, a selector valve is switched to a rim water passage side, and a water supply valve is opened. In this manner, ejection of flush water, which has been supplied from a water supply source such as tap water, from a rim water passage portion is started. Here, the water passage from the selector valve to the rim water passage portion is provided with a branching portion, and a part of flush water branched by the branching portion flows into a small water tank (chamber) provided inside a tank.

Furthermore, a float is disposed inside the small water tank, and a buoyant force acts on the float when the flush water is accumulated in the small water tank. Also, a discharge valve body is coupled to a lower side of the float, and when the flush water is accumulated in the water tank, the discharge valve body is pulled upward due to the buoyant force acting on the float, and the discharge valve body is opened. In this manner, the discharge valve body is pulled upward with a delay corresponding to a time required for a predetermined amount of flush water to be accumulated in the water tank after the ejection from the rim water passage portion is started, and the flush water retained inside the tank is supplied to the toilet.

As described above, according to the toilet washing tank device described in Patent Document 1, a part of flush water supplied to the rim water passage portion is branched and retained in the small water tank, and the discharge valve body is pulled upward with the buoyant force acting on the float disposed in the water tank. In this manner, the discharge valve (discharge valve body) is opened with a delay after water ejection from the upper spout port (rim water passage portion) is started, and washing of the toilet is executed. However, there is a problem that it is difficult to obtain a sufficient drive force to pull up the discharge valve body with the buoyant force acting on the float. In other words, a hydraulic head pressure of the flush water retained in the tank acts on the discharge valve body, and a drive force overcomes the hydraulic head pressure is needed to pull up the discharge valve body. Therefore, it is necessary to use a significantly large float to obtain a sufficient drive force, and an increase in size of the float may lead to a problem that the amount of flush water that can be retained in the tank decreases.

Therefore, an object of the present invention is to provide a flush water tank device capable of causing a discharge valve to open with a sufficient drive force with a delay after water ejection from an upper spout port is started and a flush toilet apparatus provided with the same.

SUMMARY OF THE INVENTION

In order to solve the aforementioned problem, the present invention provides a flush water tank device for supplying flush water to an upper spout port above a retained water surface in a flush toilet main body and a lower spout port below the retained water surface, the flush water tank device including: a flush water tank main body; a discharge valve that performs switching between ejection and stopping of the flush water from the lower spout port by performing switching between discharge and stopping of the flush water retained in the flush water tank main body; a water pressure driving mechanism that drives the discharge valve with a water supply pressure of the flush water supplied from a water supply source; a first on-off valve that performs switching between an ejection state and an ejection stopped state of the flush water, which has been supplied from the water supply source, from the upper spout port on the basis of a user's operation; a second on-off valve that performs switching between water supply and stopping of the flush water, which has been supplied from the water supply source, to the water pressure driving mechanism; and a delay valve opening mechanism that causes the second on-off valve to open with a delay of predetermined time after water ejection from the upper spout port is started, using a part of the flush water introduced via the first on-off valve, to supply the flush water to the water pressure driving mechanism.

According to the present invention configured as described above, the discharge valve performs switching between discharge and stopping of the flush water retained in the flush water tank main body and performs switching between ejection and stopping of the flush water from the lower spout port. On the other hand, the first on-off valve performs switching between the ejection state and the ejection stopped state of the flush water, which has been supplied from the water supply source, from the upper spout port. Also, the water pressure driving mechanism is configured to drive the discharge valve with the water supply pressure of the flush water supplied from the water supply source, and the second on-off valve performs switching between water supply and stopping of the flush water to the water pressure driving mechanism. The delay valve opening mechanism causes the second on-off valve to open with a delay of predetermined time after water ejection from the upper spout port is started, using a part of the flush water introduced via the first on-off valve, to supply the flush water to the water pressure driving mechanism, and the discharge valve is thus opened.

According to the present invention configured as described above, the water pressure driving mechanism drives the discharge valve with the water supply pressure of the flush water supplied from the water supply source, and it is thus possible to drive the discharge valve with a sufficient drive force. Also, the delay valve opening mechanism supplies the flush water to the water pressure driving mechanism and causes the discharge valve to open with a delay of predetermined time after water ejection from the upper spout port is started, and it is thus possible to start the water ejection from the lower spout port with a delay after water ejection from the upper spout port is started and thereby to effectively wash the flush toilet main body.

Preferably the delay valve opening mechanism includes a balance float that is disposed to receive a buoyant force from the flush water retained in the flush water tank main body a water receiving portion that is configured such that a part of the flush water introduced via the first on-off valve flows into the water receiving portion, and a second on-off valve driving mechanism that is connected to the balance float and the water receiving portion, and wherein the second on-off valve driving mechanism causes the second on-off valve to open when the weight of the water receiving portion increases due to flowing-in of the flush water and overcomes the buoyant force acting on the balance float in the present invention.

According to the present invention configured as described above, the second on-off valve driving mechanism causes the second on-off valve to open when the weight of the water receiving portion increases due to the flowing-in of the flush water and overcomes the buoyant force acting on the balance float, and as a result, the discharge valve is opened. Therefore, it is possible to freely set the time for the second on-off valve to open depending on the configurations of the water receiving portion and the balance float. Also, it is possible to reduce the size of the water receiving portion as well by designing a small buoyant force to act on the balance float.

Preferably the present invention further includes: a spout port water supply pipe that is connected to a downstream side of the first on-off valve and communicates with the upper spout port, the spout port water supply pipe being provided with a branching portion, and the flush water that is branched by the branching portion flowing into the water receiving portion.

According to the present invention configured as described above, it is possible to freely set the flow rate of the flush water flowing into the water receiving portion depending on design of the branching portion provided in the spout port water supply pipe and to freely set a delay time before the discharge valve is opened.

Preferably the water receiving portion is provided with a discharge hole for discharging the flush water in the water receiving portion to inside of the flush water tank main body the discharge hole allowing the flush water to be discharged at a lower flow rate than a flow rate of the flush water flowing into the water receiving portion in the present invention.

According to the present invention configured as described above, the water receiving portion is provided with the discharge hole for discharging the flush water in the water receiving portion at the lower flow rate than the flow rate of the flush water flowing into the water receiving portion. Therefore, the weight of the water receiving portion increases when the flush water flows into the water receiving portion and can thus overcome the buoyant force acting on the balance float. Also, the flush water in the water receiving portion is discharged after the flowing-in of the flush water is stopped, and it is possible to automatically return to an initial state.

Preferably the water receiving portion is disposed above a water surface at a stopped water level of the flush water tank main body in the present invention.

According to the present invention configured as described above, the water receiving portion is disposed above the water surface at the stopped water level in the flush water tank main body, the buoyant force does not act on the water receiving portion itself, and it is thus possible to effectively use the weight of the flush water retained in the water receiving portion.

Preferably the water receiving portion includes a connecting portion, the water receiving portion being connected to the balance float with a gap above the balance float by the connecting portion in the present invention.

According to the present invention configured as described above, the water receiving portion and the balance float are connected with a gap therebetween by the connecting portion, and it is thus possible to freely design the positional relationship between the water receiving portion and the balance float.

Preferably, the second on-off valve includes a diaphragm, a pressure chamber that presses the diaphragm, and a pilot valve that controls a pressure in the pressure chamber, the second on-off valve driving mechanism causes the pilot valve to open or close on the basis of a gravity acting on the water receiving portion and the buoyant force acting on the balance float in the present invention.

According to the present invention configured as described above, the second on-off valve driving mechanism causes the pilot valve of the second on-off valve to open or close on the basis of the gravity acting on the water receiving portion and the buoyant force acting on the balance float, and it is thus possible to cause the second on-off valve to open and close with a small force acting on the water receiving portion and the balance float. It is thus possible to widen the degree of freedom in designing the water receiving portion and the balance float.

Also, the present invention provides a flush toilet apparatus including: a flush toilet main body that includes an upper spout port above a retained water surface and a lower spout port below the retained water surface; and the flush water tank device according to the present invention that supplies flush water to the upper spout port and the lower spout port.

According to the flush water tank device and the flush toilet apparatus provided with the same of the present invention, it is possible to cause the discharge valve to open with a sufficient drive force with a delay after water ejection from the upper spout port is started.

DETAILED DESCRIPTION OF THE PREFERRED EMBODIMENTS

Next, a flush toilet apparatus according to embodiments of the present invention will be described with reference to the accompanying drawings.

Figure 1:
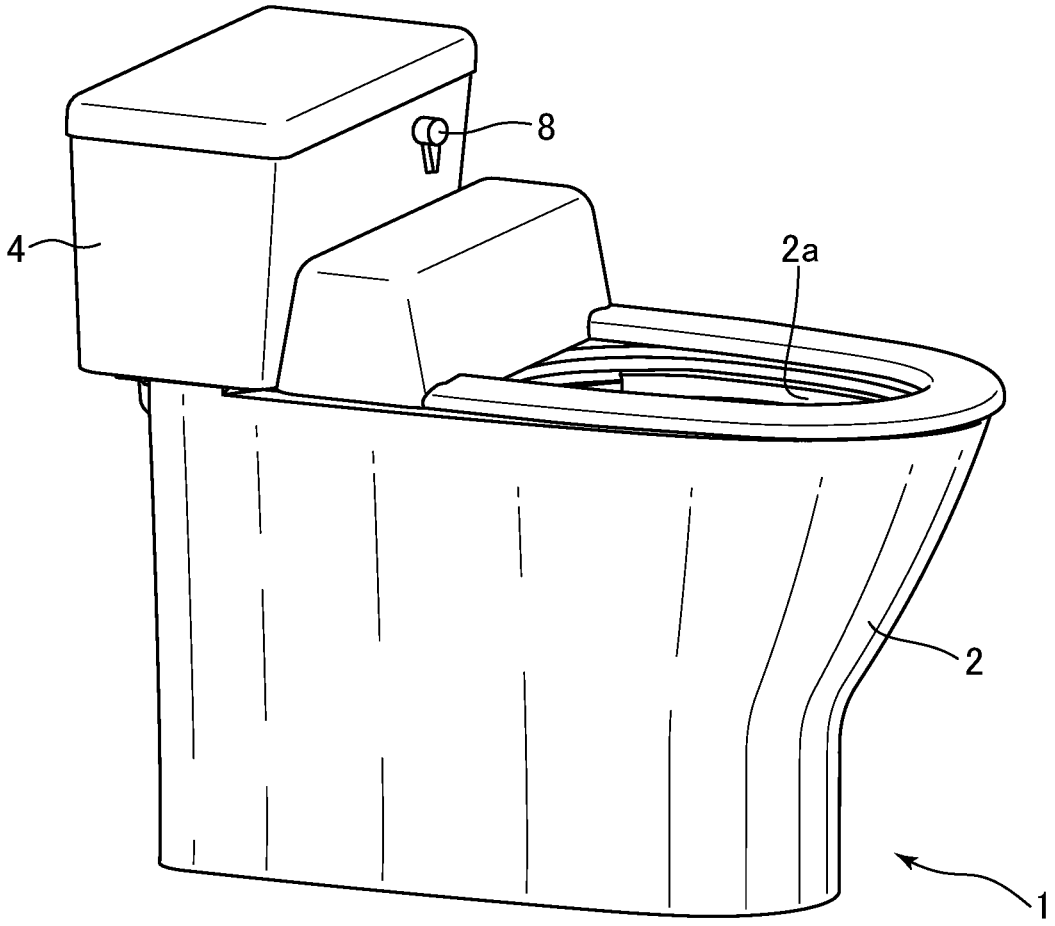
FIG. 1 is a perspective view illustrating an overall flush toilet apparatus according to a first embodiment of the present invention.
Figure 2:
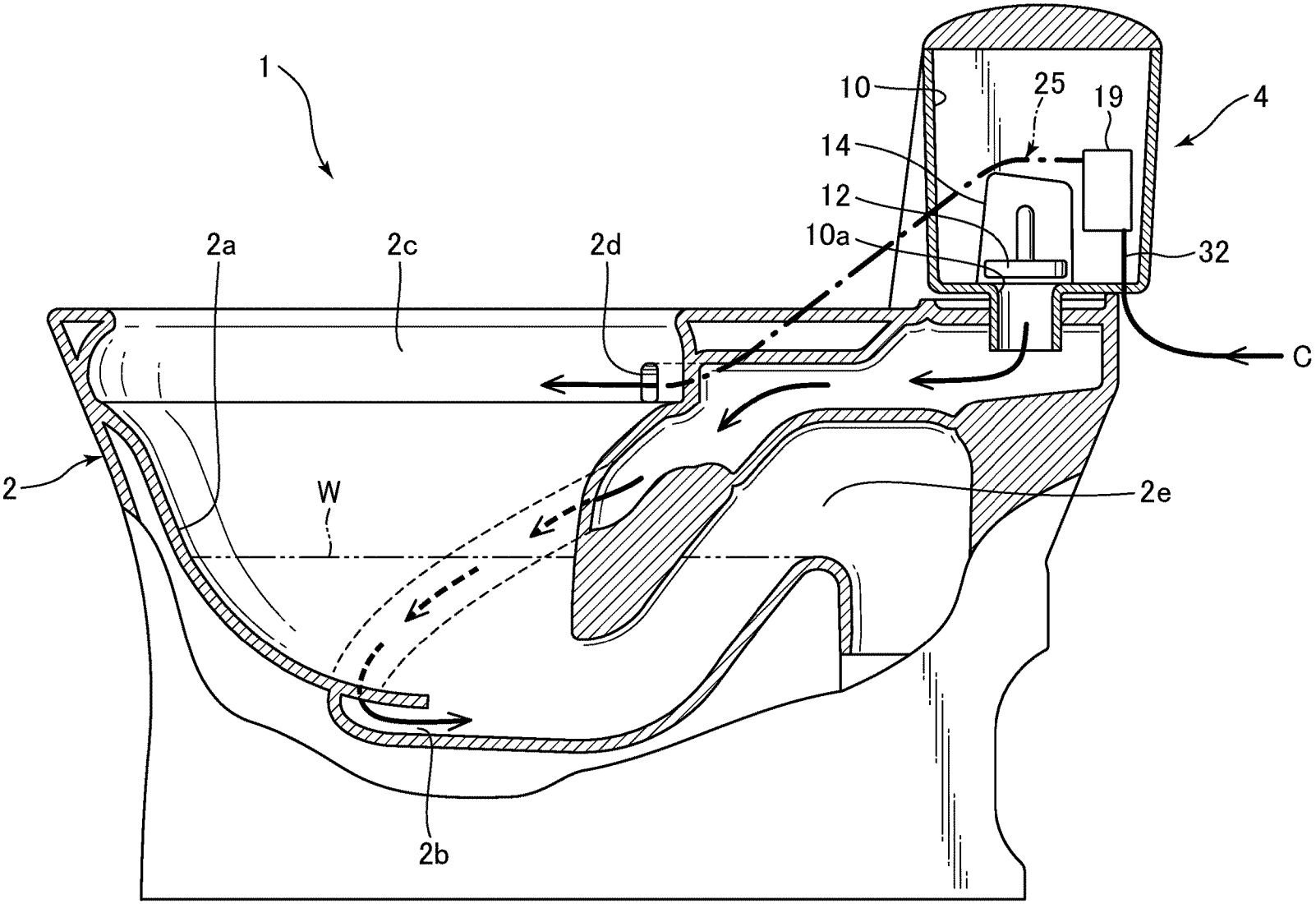
FIG. 2 is an overall sectional view of the flush toilet apparatus according to the first embodiment of the present invention.
Figure 3:
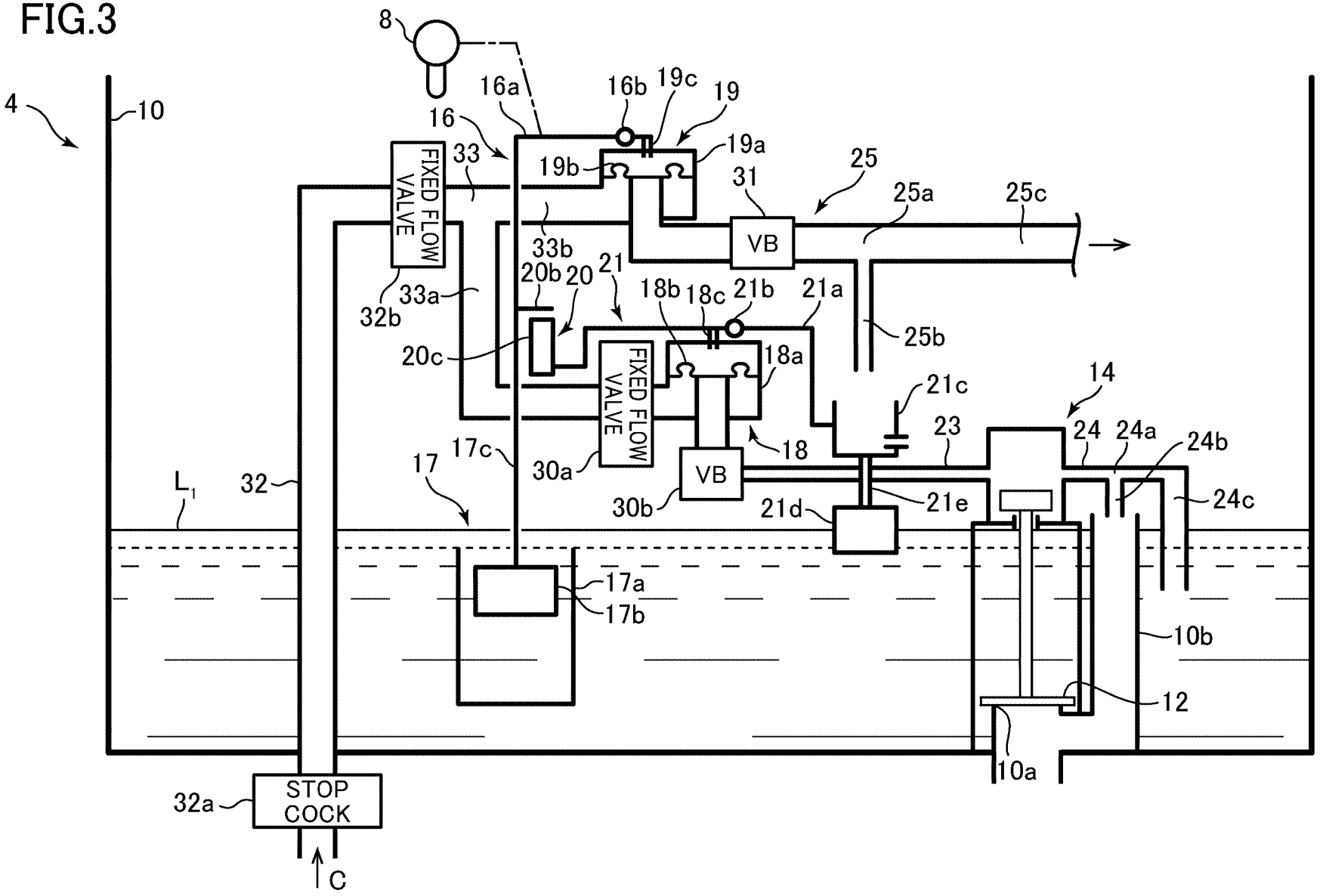
FIG. 3 is a sectional view illustrating an overview configuration of a flush water tank device according to the first embodiment of the present invention.
Figure 4:
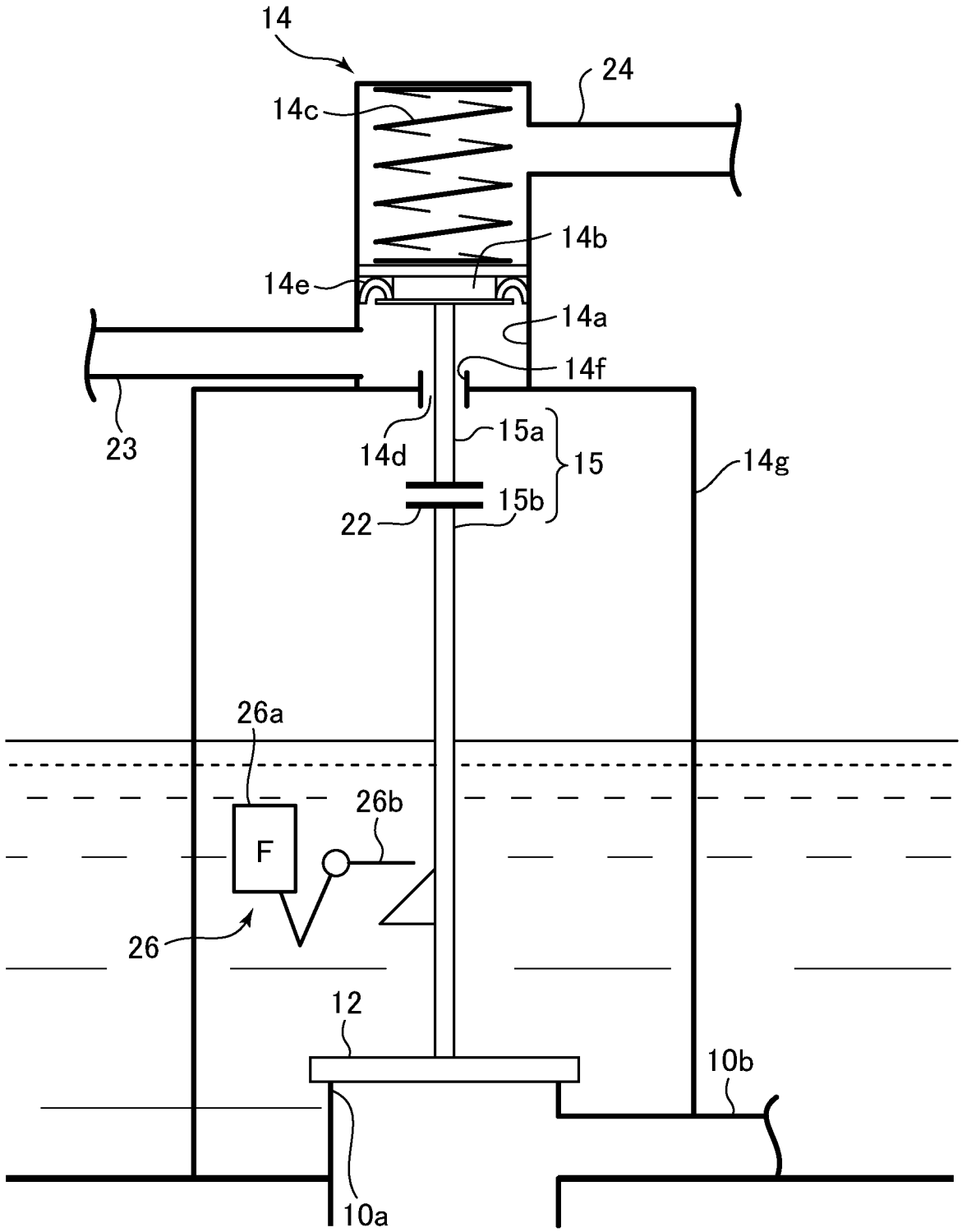
FIG. 4 is a sectional view illustrating an overview configuration of a discharge valve water pressure drive portion included in the flush water tank device according to the first embodiment of the present invention.
Figure 5:
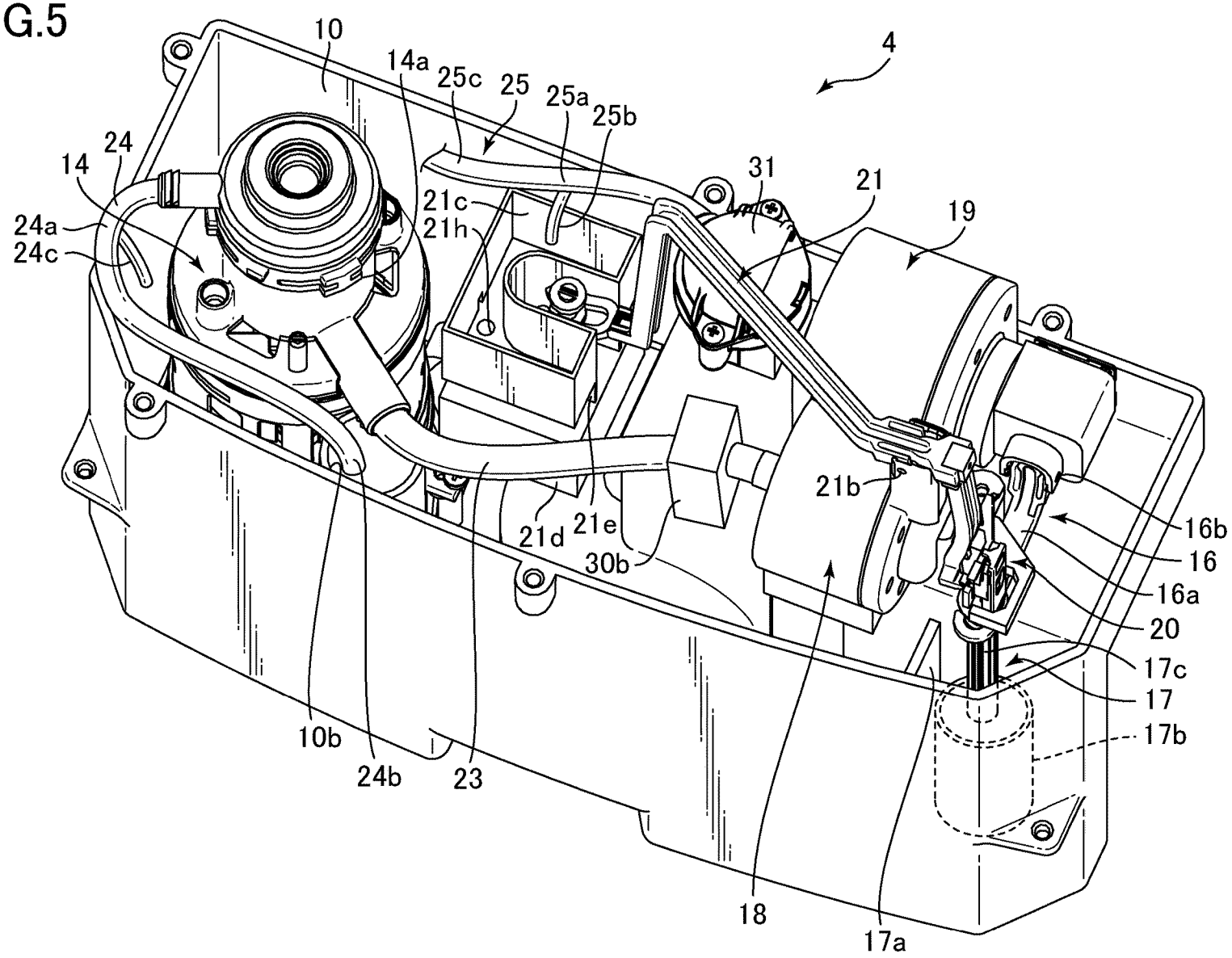
FIG. 5 is a perspective view illustrating the overall flush water tank device according to the first embodiment of the present invention.

FIG. 1 is a perspective view illustrating an overall flush toilet apparatus according to a first embodiment of the present invention. FIG. 2 is an overall sectional view of the flush toilet apparatus according to the first embodiment of the present invention. FIG. 3 is a sectional view illustrating an overview configuration of a flush water tank device according to the first embodiment of the present invention. FIG. 4 is a sectional view illustrating an overview configuration of a discharge valve water pressure drive portion included in the flush water tank device according to the first embodiment of the present invention. FIG. 5 is a perspective view illustrating the overall flush water tank device according to the first embodiment of the present invention.

As illustrated in FIGS. 1 and 2, a flush toilet apparatus 1 according to the first embodiment of the present invention is configured by a flush toilet main body 2 and a flush water tank device 4 according to the first embodiment of the present invention placed at a rear portion thereof. The flush toilet apparatus 1 according to the present embodiment is configured such that a bowl 2*a* of the flush toilet main body 2 is washed in response to an operation performed on a lever handle 8 provided in the flush water tank device 4 after utilization. The flush water tank device 4 according to the present embodiment is configured to supply flush water retained therein and flush water supplied from tap water C that is a water supply source to the flush toilet main body 2 and wash the bowl 2*a* with the flush water on the basis of an operation on the lever handle 8.

Additionally, as a modification example, the present invention can also be configured such that the bowl 2*a* is washed in response to an operation performed on a remote controller device (not illustrated) attached to a wall surface. Alternatively the present invention can also be configured such that the bowl 2*a* is washed in response to elapse of a predetermined time after a human sensor (not illustrated) provided at a toilet seat detects separation of a user from the seat. In this case, the human sensor (not illustrated) can be provided at the toilet seat, can be provided at a position where it can detect a user's motion of being seated, being separated from the seat, approaching the seat, leaving, or placing his/her hand near it, and for example, it is possible to provide the human sensor in the flush toilet main body 2 or the flush water tank device 4. Also, any human sensor (not illustrated) can be used as long as it can detect the user's motion of being seated, being separated from the seat, approaching the seat, leaving, or placing his/her hand, and for example, it is possible to use an infrared sensor or a microwave sensor as the human sensor. As described above, "on the basis of the user's operation" in the present specification means a user's arbitrary motion that serves as a trigger to start washing the toilet.

Next, the flush water tank device 4 includes a reservoir tank 10 that is a flush water tank main body for retaining flush water to be supplied to the flush toilet main body 2, a discharge valve 12 for opening and closing a drain port 10*a* provided in the reservoir tank 10, and a discharge valve water pressure drive portion 14 that is a water pressure driving mechanism for driving the discharge valve 12 as illustrated in FIG. 2. Furthermore, the flush water tank device 4 includes a water supply control valve 19 that is a first on-off valve for supplying flush water supplied from tap water C directly to the flush toilet main body 2. Here, a configuration in which the flush water retained in the reservoir tank 10 and caused to flow out by the discharge valve 12 being opened is ejected from a jet spout port 2*b* that is a lower spout port provided on the lower side of a retained water surface W in the bowl 2*a* of the flush toilet main body 2 at the time of washing of the toilet is adopted. Also, a configuration in which the flush water supplied from the tap water C and supplied via the water supply control valve 19 is ejected from a rim spout port 2*d* that is an upper spout port provided at a rim 2*c* of the bowl 2*a* above the retained water surface W in the bowl 2*a* at the time of washing of the toilet is adopted.

Next, as illustrated in FIGS. 3 and 5, the flush water tank device 4 further includes a water supply valve driving mechanism 16 that is a first on-off valve driving mechanism caused to move from a stop position where the water supply control valve 19 is brought into an ejection stopped state to an ejection position where the water supply control valve 19 is brought into an ejection state on the basis of a user's operation and a biasing mechanism 17 that generates a biasing force such that the water supply valve driving mechanism 16 is moved to the stop position. Also, the flush water tank device 4 includes a holding mechanism 20 that holds the water supply valve driving mechanism 16, which has been moved to the ejection position, at the ejection position against a biasing force of the biasing mechanism 17. Furthermore, the flush water tank device 4 includes a discharge valve control valve 18 that is a second on-off valve for controlling water supply to the discharge valve water pressure drive portion 14 and a delay valve opening mechanism 21 that causes the discharge valve control valve 18 to open with a delay of predetermined time after water ejection from the rim spout port 2*d* is started using a part of the flush water introduced via the water supply control valve 19 and supplies the flush water to the discharge valve water pressure drive portion 14.

The reservoir tank 10 is a tank configured to retain the flush water to be supplied to the jet spout port 2*b* of the flush toilet main body 2, and the drain port 10*a* (FIG. 3) for discharging the retained flush water to the flush toilet main body 2 is formed at a bottom portion thereof. Also, an overflow pipe 10*b* is connected to a downstream side of the drain port 10*a* inside the reservoir tank 10. The overflow pipe 10*b* stands vertically from the vicinity of the drain port 10*a* and extends upward beyond a stopped water level $L_1$ of the flush water retained in the reservoir tank 10. Therefore, the flush water flowing in from an upper end of the overflow pipe 10*b* bypasses the drain port 10*a* and flows out directly from the jet spout port 2*b* of the flush toilet main body 2.

As illustrated in FIG. 4, the discharge valve 12 has a valve body disposed to open and close the drain port 10*a* and is opened by the discharge valve 12 being pulled upward, and the flush water in the reservoir tank 10 is discharged to the flush toilet main body 2 and is ejected from the jet spout port 2*b* provided at a lower portion of the bowl 2*a*.

Next, a structure of the discharge valve water pressure drive portion 14 will be described with reference to FIG. 4.

The discharge valve water pressure drive portion 14 is configured to drive the discharge valve 12 using a water supply pressure of the flush water supplied from the tap water C. As illustrated in FIG. 4, the discharge valve water pressure drive portion 14 includes a cylinder 14*a* into which water that has flowed out from the discharge valve control valve 18 and has been supplied through an inlet pipe 23 flows, a piston 14*b* that is slidably disposed in the cylinder 14*a*, and a rod 15 that projects from a lower end of the cylinder 14*a* and drives the discharge valve 12. Moreover, a spring 14*c* is disposed inside the cylinder 14*a* and biases the piston 14*b* downward, a packing 14*e* is attached to the piston 14*b*, and water tightness is secured between an inner wall surface of the cylinder 14*a* and the piston 14*b*. Also, the cylinder 14*a* is supported above the drain port 10*a* by a frame 14*g*. Furthermore, a clutch mechanism 22 is provided at a midpoint of the rod 15, and the rod 15 is separated into an upper rod 15*a* and a lower rod 15*b* by the clutch mechanism 22.

The cylinder 14*a* is a cylindrical member, is disposed with an axial line thereof directed in a vertical direction, and slidably receives the piston 14*b* therein. Also, the inlet pipe 23 is connected to a lower end portion of the cylinder 14*a* such that, water flowing out from the discharge valve control valve 18 flows into the cylinder 14*a* from the lower end portion. Therefore, the piston 14*b* in the cylinder 14*a* is pushed upward against a biasing force of the spring 14*c* due to the water that has flowed into the cylinder 14*a*.

On the other hand, an outlet hole is provided at an upper end portion of the cylinder 14*a*, and the outlet pipe 24 communicates with the inside of the cylinder 14*a* through the outlet hole. Therefore, once water flows into the cylinder 14*a* from the inlet pipe 23 connected to the lower portion of the cylinder 14*a*, the piston 14*b* is pushed upward from the lower portion of the cylinder 14*a*. Then, when the piston 14*b* is pushed upward above the outlet hole, the water flowing into the cylinder 14*a* flows out from the outlet hole through the outlet, pipe 24. In other words, the inlet pipe 23 and the outlet pipe 24 communicate with each other via the inside of the cylinder 14*a* when the piston 14*b* is moved upward.

Also, as illustrated in FIGS. 3 and 5, the outlet pipe 24 is provided with a branching portion 24*a*, and a first downcomer 24*b* branched from the branching portion 24*a* opens downward inside the overflow pipe 10*b*. A second downcomer 24*c* extending downward from the branching portion 24*a* allows water to flow out into the reservoir tank 10. Therefore, a part of the flush water flowing out from the cylinder 14*a* flows into the overflow pipe 10*b*, and remaining flush water is retained in the reservoir tank 10.

Next, as illustrated in FIG. 4, the rod 15 is a rod-shaped member connected to a lower surface of the piston 14*b* and extends to project downward from the inside of the cylinder 14*a* through a through-hole 14*f* formed in a bottom surface of the cylinder 14*a*. Also, the discharge valve 12 is connected to the lower end of the rod 15, and the rod 15 connects the piston 14*b* to the discharge valve 12. Therefore, when water flows into the cylinder 14*a* and the piston 14*b* is pushed upward, the rod 15 connected to the piston 14*b* lifts the discharge valve 12 upward, and the discharge valve 12 is opened.

Also, a clearance 14*d* is provided between the rod 15 projecting from the lower side of the cylinder 14*a* and an inner wall of the through-hole 14*f* of the cylinder 14*a*, and a part of water flowing into the cylinder 14*a* flows out from the clearance 14*d*. The water flowing out from the clearance 14*d* flows into the reservoir tank 10. Note that since the clearance 14*d* is relatively narrow and a flow channel resistance is large, the pressure in the cylinder 14*a* increases due to the water flowing into the cylinder 14*a* from the inlet pipe 23 even in a state in which the water flows out from the clearance 14*d*, and the piston 14*b* is pushed upward against the biasing force of the spring 14*c*.

Furthermore, the clutch mechanism 22 is provided at a midpoint, of the rod 15. The clutch mechanism 22 is configured to separate the rod 15 into the upper rod 15*a* and the lower rod 15*b* when the discharge valve 12 is lifted by a predetermined distance along with the rod 15. In a state in which the clutch mechanism 22 is separated, the lower rod 15*b* does not move in conjunction with motion of the piston 14*b* and an upper portion of the upper rod 15*a*, and the lower rod 15*b* is lowered due to a gravity along with the discharge valve 12 while working against the buoyant force.

Also, a discharge valve float mechanism 26 is provided in the vicinity of the discharge valve 12. The discharge valve float mechanism 26 is configured such that a delay is applied to the lower rod 15*b* and the discharge valve 12 being lowered and causing the drain port 10*a* to be closed after the rod 15 is lifted by a predetermined distance and the lower rod 15*b* is separated by the clutch mechanism 22. Specifically, the discharge valve float mechanism 26 includes a float portion 26*a* and an engaging portion 26*b* that moves in conjunction with the float portion 26*a*.

The engaging portion 26*b* is configured to establish engagement with the lower rod 15*b* separated and lowered by the clutch mechanism 22 and prevent the lower rod 15*b* and the discharge valve 12 from being lowered and seated in the drain port 10*a*. Then, when the float portion 26*a* is lowered along with lowering of a water level in the reservoir tank 10, and the water level in the reservoir tank 10 is lowered to a predetermined water level, then the float portion 26*a* causes the engaging portion 26*b* to turn, and the engagement between the engaging portion 26*b* and the lower rod 15*b* released. Through the release of the engagement, the lower rod 15*b* and the discharge valve 12 are lowered and are seated in the drain port 10*a*. In this manner, the closing of the discharge valve 12 is delayed, and an appropriate amount of flush water is drained from the drain port 10*a*.

Also, as illustrated in FIG. 3, a fixed flow valve 30*a* is provided on the upstream side of the discharge valve control valve 18. The fixed flow valve 30*a* is configured to adjust a flow rate such that the flush water supplied from the tap water C flows into the discharge valve control valve 18 at a flow rate that is appropriate to cause the discharge valve water pressure drive portion 14 to operate. Furthermore, the inlet pipe 23 that connects the discharge valve control valve 18 to the discharge valve water pressure drive portion 14 is provided with a vacuum breaker 30*b*. In a case in which a pressure on the side of the discharge valve control valve 18 becomes a negative pressure, the vacuum breaker 30*b* suctions external air to the inlet pipe 23 and prevents a backflow of water from the side of the discharge valve water pressure drive portion 14.

Figure 11:
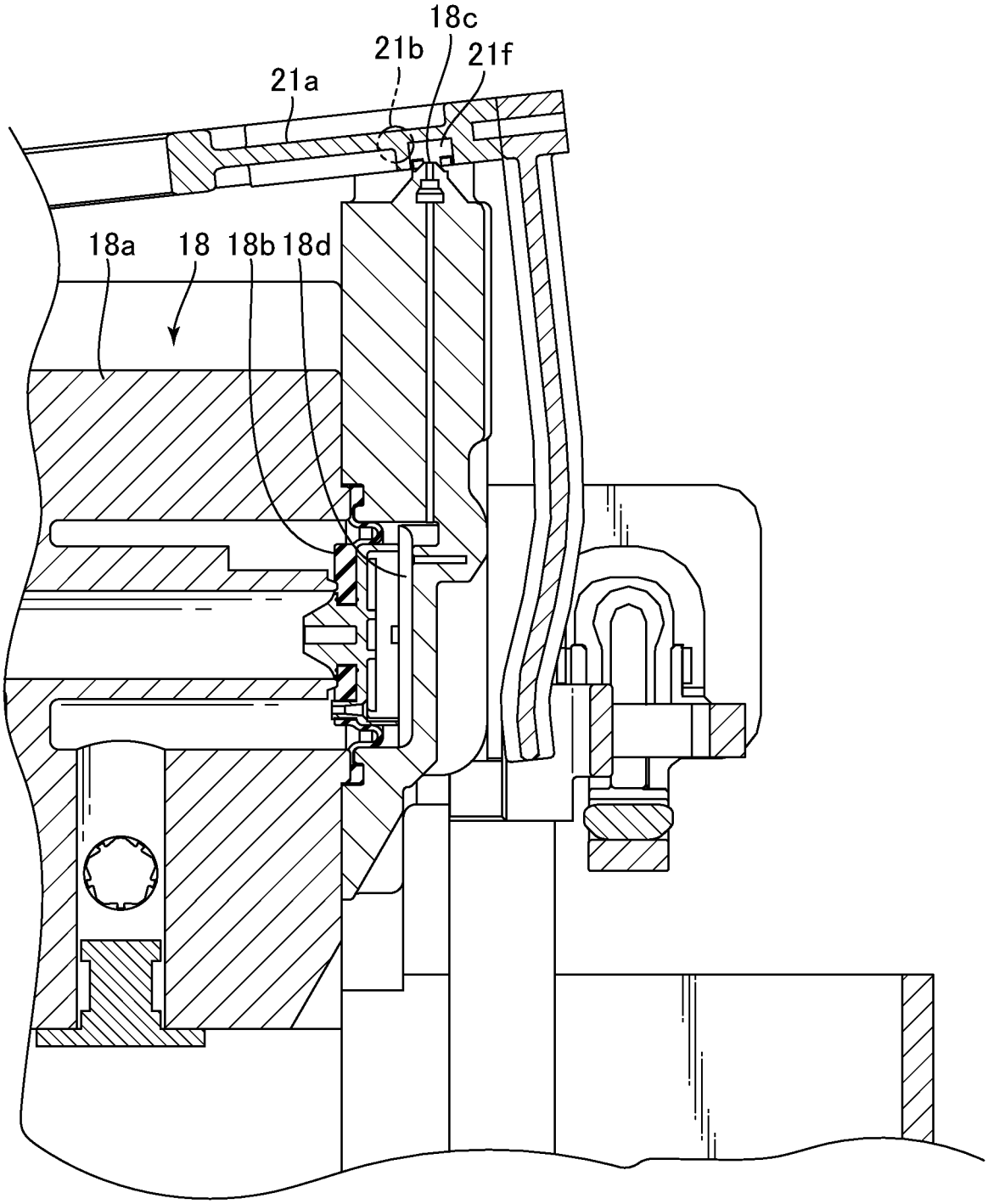
FIG. 11 is a sectional view illustrating an internal structure of a discharge valve control valve included in the flush water tank device according to the first embodiment of the present invention.

Next, the discharge valve control valve 18 includes a control valve main body portion 18*a*, a main valve body 18*b* that is a diaphragm disposed in the control valve main body portion 18*a*, and a pilot valve port 18*c* (FIG. 11). Note that the pilot valve port 18*c* included in the discharge valve control valve 18 is configured to be opened and closed by a pilot valve 21*f* (FIG. 11) provided in the delay valve opening mechanism 21 as will be described later. In other words, the pilot valve 21*f* constitutes a part of the discharge valve control valve 18 and controls the pressure in a pressure chamber 18*d* (FIG. 11) provided in the control valve main body portion 18*a*. When the pilot valve port 18*c* is closed by the pilot valve 21*f*, the pressure in the pressure chamber 18*d* increases, and the main valve body 18*b* is closed. Also, when the pilot valve port 18*c* is opened, the pressure in the pressure chamber 18*d* decreases, and the main valve body 18*b* of the discharge valve control valve 18 is opened. In this manner, the main valve body 18*b* of the discharge valve control valve 18 is opened or closed, and water supply or stopping thereof to the discharge valve water pressure drive portion 14 are controlled, on the basis of the operation of the delay valve opening mechanism 21.

In other words, the discharge valve control valve 18 controls supply and stopping of the supplied flush water to the discharge valve water pressure drive portion 14. In the present embodiment, the entire amount of flush water flowing out from the discharge valve control valve 18 is supplied to the discharge valve water pressure drive portion 14 through the inlet pipe 23 as illustrated in FIG. 3. A part of the flush water that has been supplied to the discharge valve water pressure drive portion 14 flows out from the clearance 14*d* between the inner wall of the through-hole 14*f* (FIG. 4) of the cylinder 14*a* and the rod 15 and flows into the reservoir tank 10. Also, a large part of the water that has been supplied to the discharge valve water pressure drive portion 14 flows out from the cylinder 14*a* through the outlet pipe 24 and flows into each of the overflow pipe 10*b* and the reservoir tank 10 as described above.

On the other hand, the flush water supplied from the tap water C is supplied to the discharge valve control valve 18 via a stop cock 32*a*, a fixed flow valve 32*b*, a water supply pipe branching portion 33, and a first branching pipe 33*a* as illustrated in FIG. 3. The stop cock 32*a* is disposed outside the reservoir tank 10, and the fixed flow valve 32*b* is connected to the inside of the reservoir tank 10 on the downstream side thereof. The water supply pipe branching portion 33 is provided on the downstream side of the fixed flow valve 32*b*, and the first branching pipe 33*a* branched by the water supply pipe branching portion 33 is connected to the discharge valve control valve 18.

The stop cock 32*a* is provided to stop water supply to the flush water tank device 4 at the time of maintenance or the like and is typically used in an opened state. The fixed flow valve 32*b* is provided to allow water supplied from the tap water C to flow into the discharge valve control valve 18 and the water supply control valve 19 at a predetermined flow rate and is configured such that water is supplied at a constant flow rate regardless of an installation environment of the flush toilet apparatus 1.

On the other hand, a second branching pipe 33*b* branched by the water supply pipe branching portion 33 is connected to the water supply control valve 19.

The water supply control valve 19 is configured to cause water supplied from the second branching pipe 33*b* to flow out to a rim water supply pipe 25 that is a spout port water supply pipe. The rim water supply pipe 25 communicates with the rim spout port 2*d* of the flush toilet main body 2 (not illustrated in FIG. 3), and the flus water that has flowed into the rim water supply pipe 25 is ejected as rim flush water for washing the bowl 2*a* from the rim spout port 2*d*. Also, a vacuum breaker (FIG. 5) is provided at a midpoint of the rim water supply pipe 25. It is thus possible to prevent water from flowing backward from the side of the flush toilet main body 2 to the water supply control valve 19 when the pressure on the side of the water supply control valve 19 becomes a negative pressure. Furthermore, the rim water supply pipe 25 on the downstream side of the vacuum breaker 31 is provided with a branching portion 25*a*, a part of the flush water flowing in the rim water supply pipe 25 flows into the downcomer 25*b*, and remaining flush water is ejected from the rim spout port 2*d*.

Figure 10:
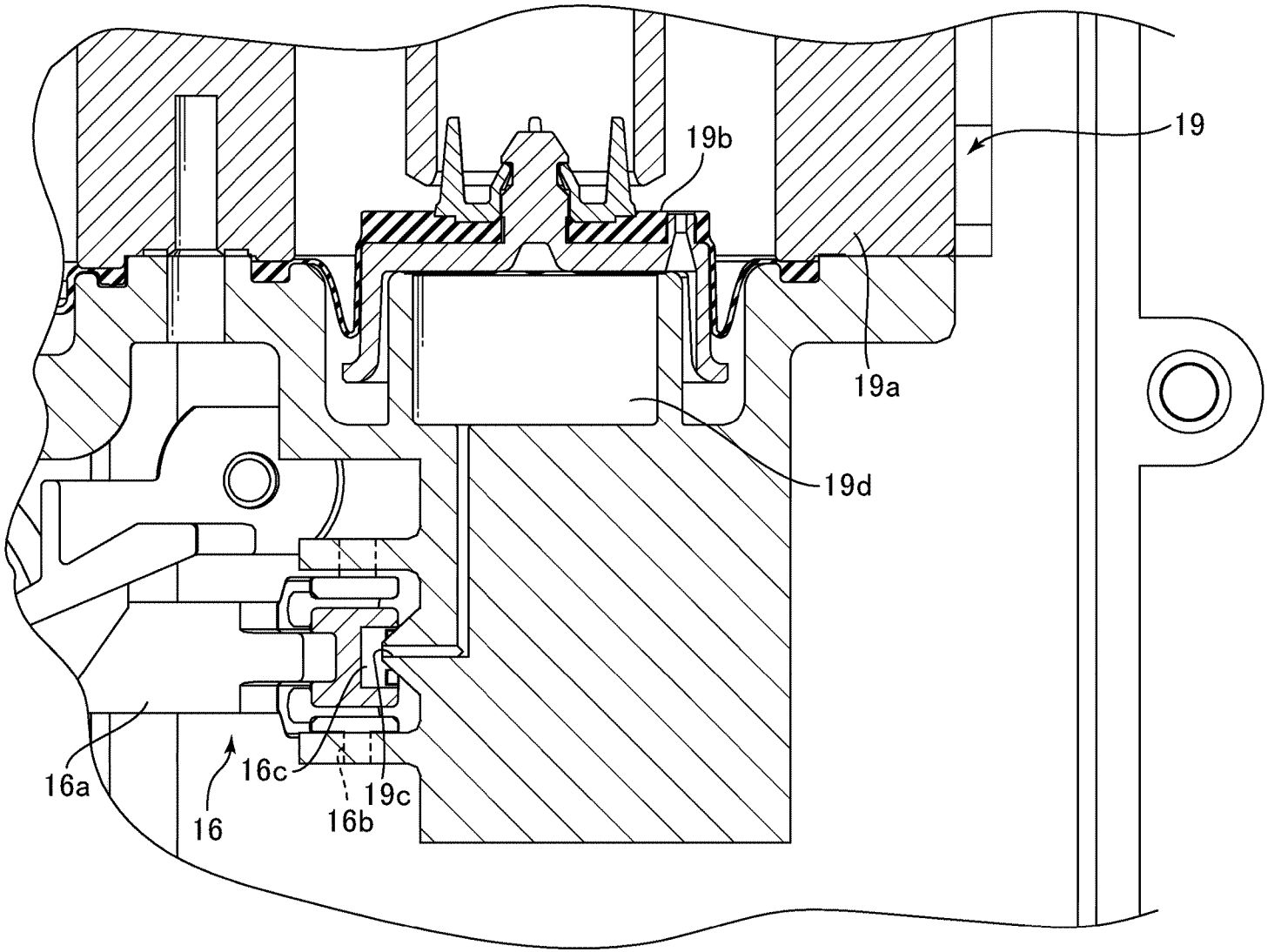
FIG. 10 is a sectional view illustrating an internal structure of a water supply control valve included in the flush water tank device according to the first embodiment of the present invention.

The water supply control valve 19 includes a water supply valve main body portion 19*a*, a main valve body 19*b* disposed in the water supply valve main body portion 19*a*, and a pilot valve port 19*c* (FIG. 10). Also, the pilot valve port 19*c* included in the water supply control valve 19 is configured to be opened and closed by the water supply valve driving mechanism 16 as will be described later. In other words, the water supply valve driving mechanism 16 is configured to control the pressure in a pressure chamber 19*d* (FIG. 10) provided in the water supply valve main body portion 19*a* by opening and closing the pilot valve port 19*c* provided at the water supply valve main body portion 19*a*.

Next, newly referring to FIGS. 6 to 11, configurations of the water supply valve driving mechanism 16, the biasing mechanism 17, the holding mechanism 20, and the delay valve opening mechanism 21 will be described.

Figure 6:
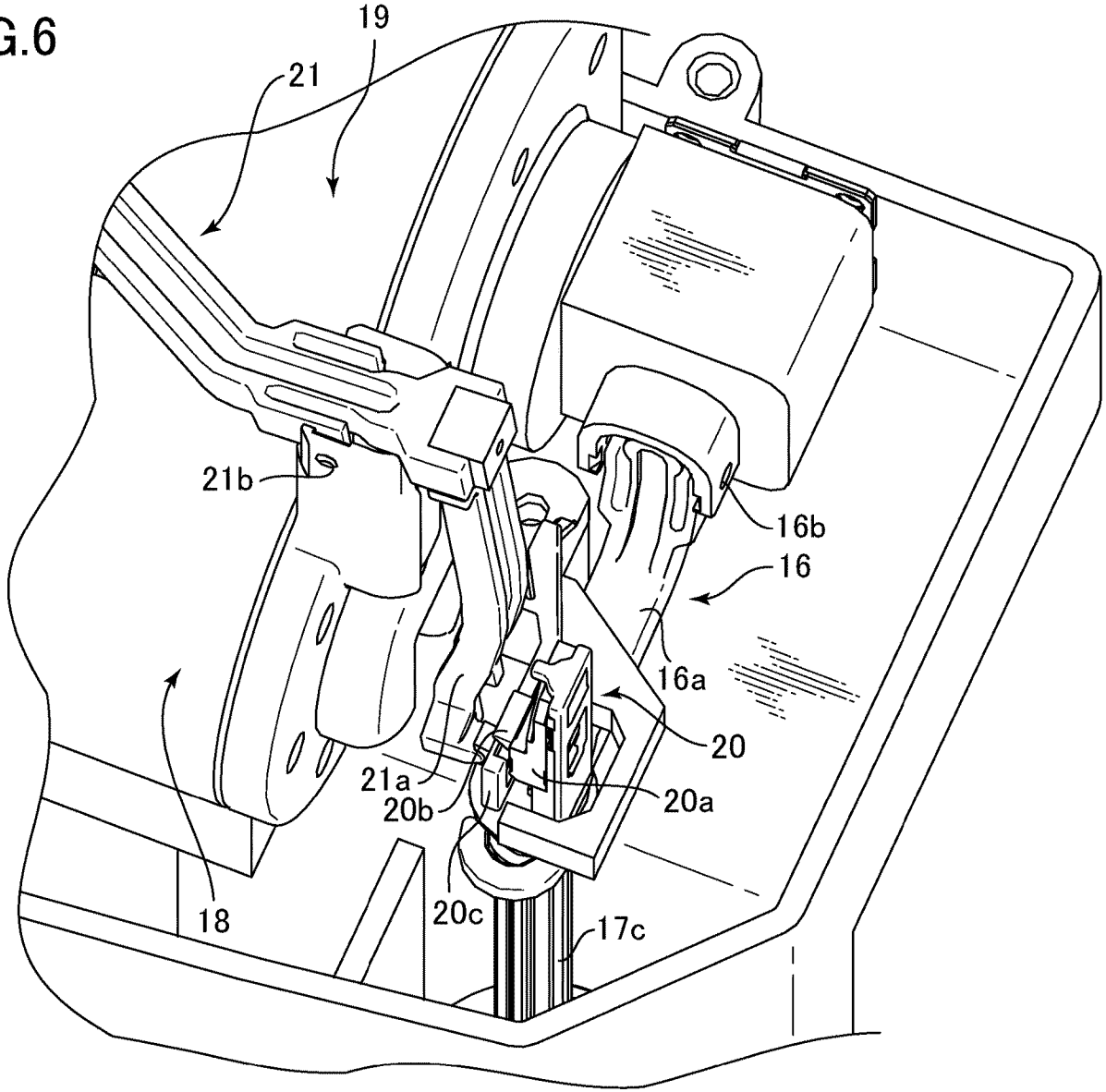
FIG. 6 is a perspective view partially illustrating a water supply valve driving mechanism and a delay valve opening mechanism included in the flush water tank device according to the first embodiment of the present invention.
Figure 7:
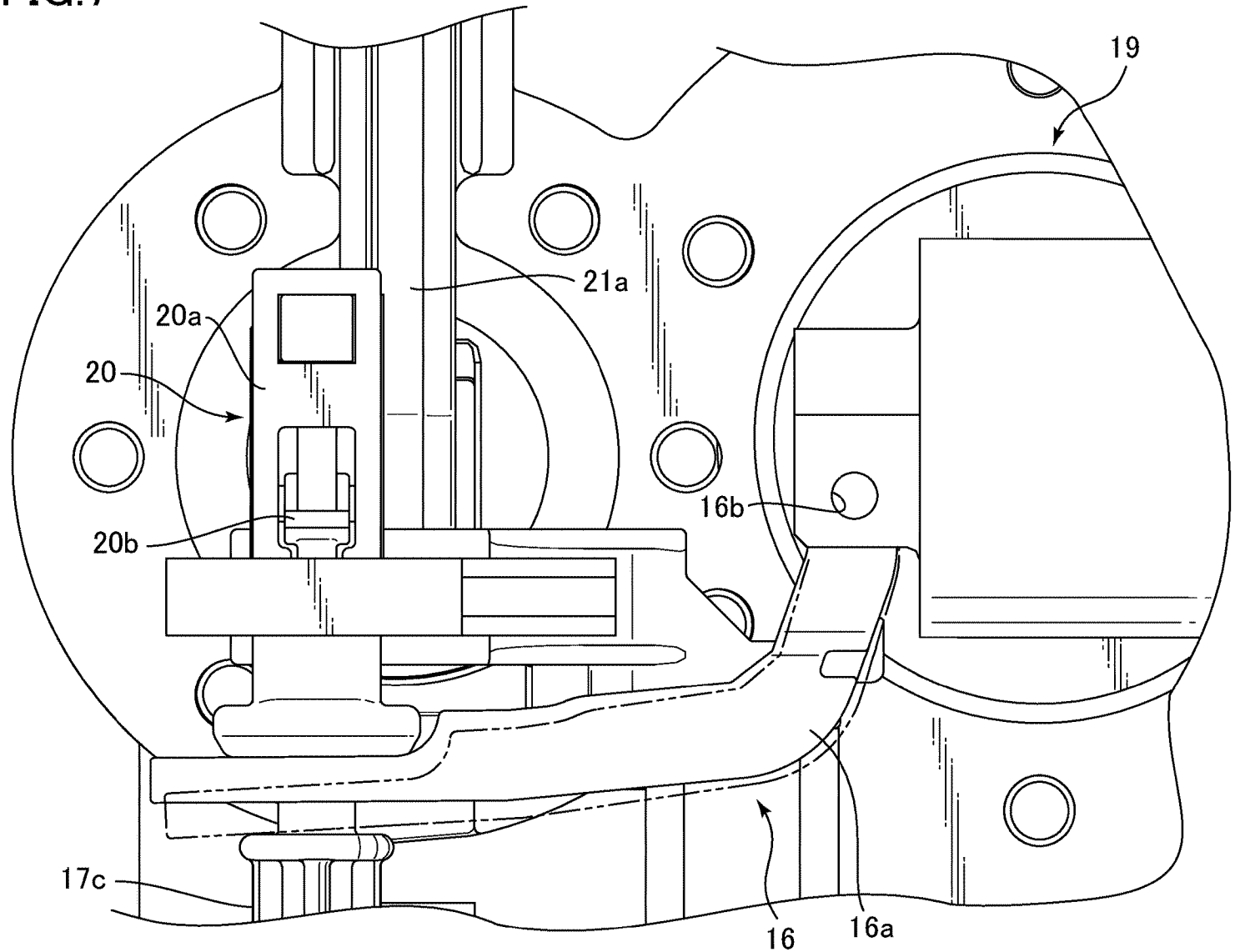
FIG. 7 is a side view illustrating the water supply valve driving mechanism included in the flush water tank device according to the first embodiment of the present invention in an enlarged manner.
Figure 8:
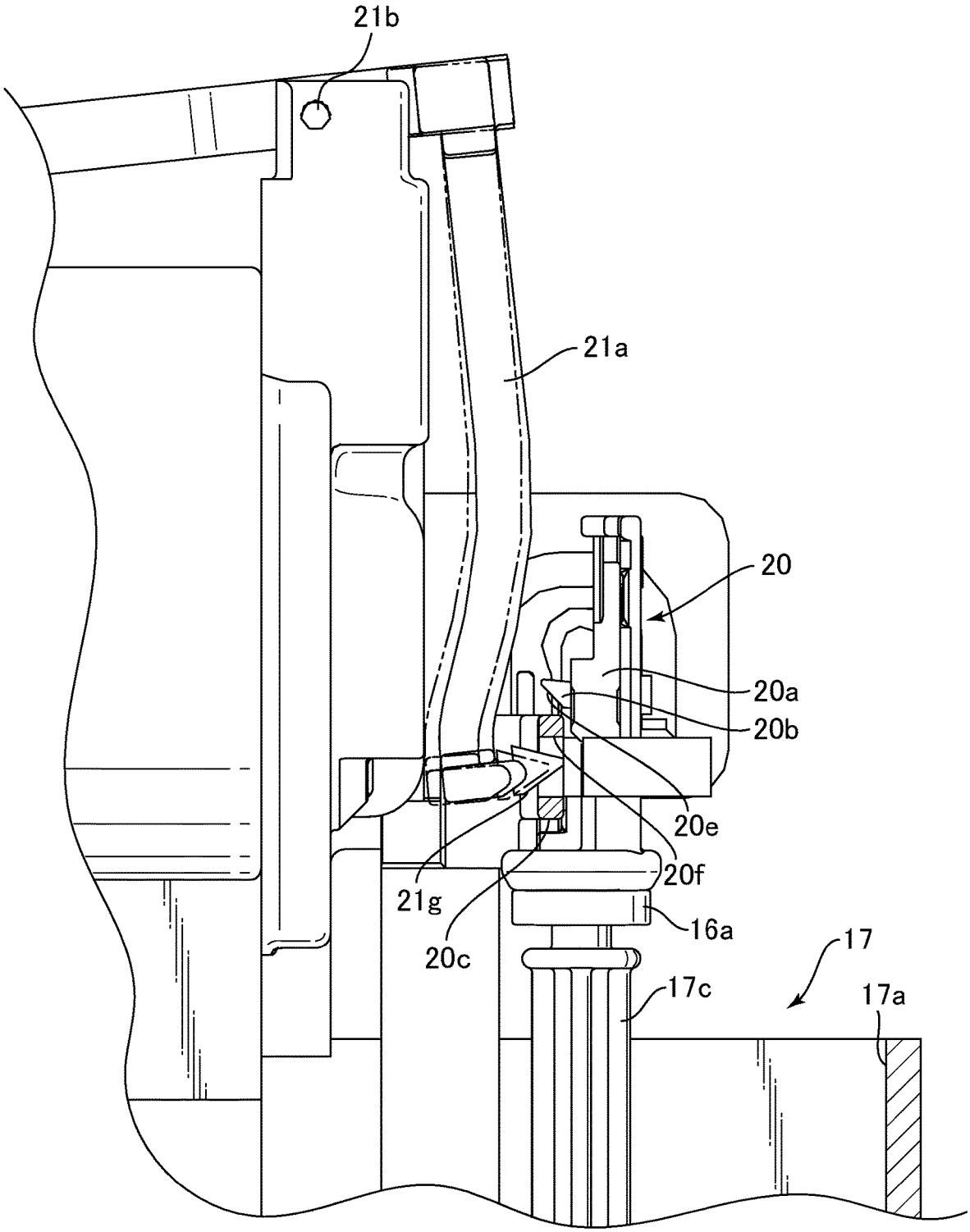
FIG. 8 is a back view illustrating a holding mechanism and the delay valve opening mechanism included in the flush water tank device according to the first embodiment of the present invention in an enlarged manner.
Figure 9:
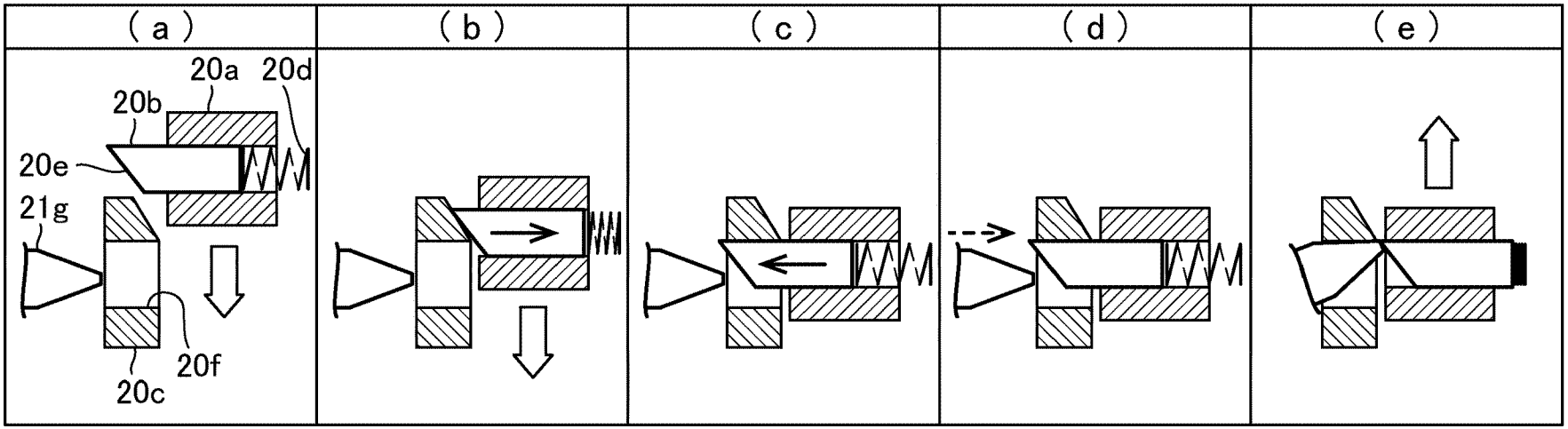
FIG. 9 is a schematic view for explaining effects of the holding mechanism and the delay valve opening mechanism included in the flush water tank device according to the first embodiment of the present invention.

FIG. 6 is a perspective view partially illustrating the water supply valve driving mechanism 16 and the delay valve opening mechanism 21. FIG. 7 is a side view illustrating the water supply valve driving mechanism 16 in an enlarged manner. FIG. 8 is a back view illustrating the holding mechanism 20 and the delay valve opening mechanism 21 in an enlarged manner. FIG. 9 is a schematic view for explaining effects of the holding mechanism 20 and the delay valve opening mechanism 21. FIG. 10 is a sectional view illustrating an internal structure of the water supply control valve 19. FIG. 11 is a sectional view illustrating an internal structure of the discharge valve control valve 18.

As illustrated in FIGS. 6 and 7, the water supply valve driving mechanism 16 is configured of a drive arm member 16*a* that is curved into an L shape and a support portion 16*b* that rotatably supports the drive arm member 16*a*. The drive arm member 16*a* is supported such that it is rotatable about the support portion 16*b* and is configured to be moved between a stopping position illustrated by the solid line in FIG. 7 and an ejection position illustrated by the imaginary line. Also, the drive arm member 16*a* is provided with a pilot valve portion 16*c* that opens and closes the pilot valve port 19*c* of the water supply control valve 19 as illustrated in FIG. 10. The pilot valve port 19*c* is closed by the pilot valve portion 16*c* when the drive arm member 16*a* is moved to the stopping position, and the pilot valve port 19*c* is opened when the drive arm member 16*a* is moved to the ejection position. Also, the pilot valve port 19*c* communicates with the pressure chamber 19*d* in the water supply valve main body portion 19*a* of the water supply control valve 19.

In other words, since, the pilot valve port 19*c* is closed by the pilot valve portion 16*c* of the drive arm member 16*a* in a state in which the drive arm member 16*a* has been moved to the stopping position, the pressure in the pressure chamber 19*d* of the water supply control valve 19 increases, and the main valve body 19*b* of the water supply control valve 19 is closed. On the other hand, since the pilot valve port 19*c* is opened in a state in which the drive arm member 16*a* has been moved to the ejection position, the pressure in the pressure chamber 19*d* decreases, and the main valve body 19*b* is opened. Also, the drive arm member 16*a* of the water supply valve driving mechanism 16 is moved from the stopping position to the ejection position by the user operating the lever handle 8 (FIG. 3). In this manner, the pilot valve port 19*c* is opened, the main valve body 19*b* of the water supply control valve 19 is opened, and water ejection from the rim spout port 2*d* is started. Note that the lever handle 8 and the drive arm member 16*a* are connected with a wire (not illustrated).

As illustrated in FIGS. 3 and 5, the biasing mechanism 17 includes a small tank 17*a* that is provided in the reservoir tank 10 and retains flush water, a biasing float 17*b* that is disposed in the small tank 17*a*, and a biasing rod 17*c* that extends upward from the biasing float 17*b*. The small tank 17*a* is a small tank provided inside the reservoir tank 10, and the small tank 17*a* is always kept in a full water state regardless of the water level in the reservoir tank 10. The biasing float 17*b* is a float disposed in a state in which it is submerged inside the small tank 17*a* and is configured to always receive a buoyant force from the flush water retained in the small tank 17*a* and generates a biasing force directed upward regardless of the water level in the reservoir tank 10. The biasing rod 17*c* is a rod-shaped member extending upward from an upper portion of the biasing float 17*b*, and the upper end portion of the biasing rod 17*c* is connected to one end portion of the drive arm member 16*a* of the water supply valve driving mechanism 16 as illustrated in FIG. 7. In this manner, the one end portion of the drive arm member 16*a* is biased upward, and as a result, the drive arm member 16*a* is biased to the stopping position thereof.

Note that in the present embodiment, the biasing mechanism 17 includes the small tank 17*a* and the biasing float 17*b* and generates a biasing force by the buoyant force acting on the biasing float 17*b*. In regard to this, it is also possible to configure the biasing mechanism 17 such that the biasing force is generated by an elastic member such as a coil spring in a modification example.

The holding mechanism 20 includes a holding mechanism main body portion 20*a*, an engaging member 20*b* that is attached to the holding mechanism main body portion 20*a*, and an engaged member 20*c* that is engaged with the engaging member 20*b* as illustrated in FIGS. 7 and 8. The holding mechanism main body portion 20*a* is attached to the upper end portion of the biasing rod 17*c* of the biasing mechanism 17 and is configured to move in the up-down direction along with the biasing rod 17*c*. The engaging member 20*b* is a member that is movably attached to the holding mechanism main body portion 20*a* and is moved between an engagement position (the section in (c) of FIG. 9) at which it projects toward the engaged member 20*c* and an engagement released position (the section in (e) of FIG. 9) at which it does not establish engagement with the engaged member 20*c*. Also, the engaging member 20*b* is biased toward the engagement position by a spring 20*d* (FIG. 9) that is an elastic member. Furthermore, a distal end of the engaging member 20*b* is provided with a sloped surface 20*e* that is sloped relative to the moving direction (up-down direction) of the holding mechanism main body portion 20*a*.

The engaged member 20*c* is a plate-shaped member fixed at a position where it faces the holding mechanism main body portion 20*a* and is provided with an opening 20*f* for receiving the engaging member 20*b*. When the drive arm member 16*a* is turned about the support portion 16*b* by the user operating the lever handle 8, then the biasing rod 17*c* and the holding mechanism main body portion 20*a* attached thereto are pushed downward as illustrated in the section (a) of FIG. 9. When the holding mechanism main body portion 20*a* is pushed downward, the sloped surface 20*e* of the engaging member 20*b* projecting from the holding mechanism main body portion 20*a* abuts on the upper end of the engaged member 20*c* disposed to face the holding mechanism main body portion 20*a*. When the holding mechanism main body portion 20*a* is further pushed downward, the sloped surface 20*e* of the engaging member 20*b* slides to the upper end of the engaged member 20*c*, and the distal end of the engaging member 20*b* moves backward to the side of the holding mechanism main body portion 20*a* as illustrated in the section (b) of FIG. 9. In other words, the engaging member 20*b* is moved from the engagement position to the engagement released position against the biasing force of the spring 20*d* by sliding to the engaged member 20*c*.

If the holding mechanism main body portion 20*a* is further pushed downward, and the drive arm member 16*a* is moved to the ejection position, the engaging member 20*b* is moved to a position at which it matches the opening 20*f* provided in the engaged member 20*c*. When the engaging member 20*b* matches the opening 20*f* of the engaged member 20*c*, then the engaging member 20*b* projects to the inside of the opening 20*f* of the engaged member 20*c* due to the biasing force of the spring 20*d* as illustrated in the section (c) of FIG. 9. In other words, the engaging member 20*b* is moved from the engagement released position to the engagement position, and engagement is established between the engaging member 20*b* and the engaged member 20*c*. In this state, the holding mechanism main body portion 20*a* is kept at the position against the biasing force generated by the biasing mechanism 17. In this manner, the drive arm member 16*a* is kept at the ejection position against the biasing force of the biasing mechanism 17.

Next, a configuration of the delay valve opening mechanism 21 will be described.

As illustrated in FIG. 5, the delay valve opening mechanism 21 includes a transmission arm member 21*a* that is a second on-off valve driving mechanism formed substantially into a gate shape, a support portion 21*b* that rotatably supports the transmission arm member 21*a*, a water receiving portion 21*c* that is attached to one end portion of the transmission arm member 21*a*, a balance float 21*d* that is provided on the lower side of the water receiving portion 21*c*, and a connecting portion 21*e* (FIG. 3) that connects the water receiving portion 21*c* to the balance float 21*d*.

The transmission arm member 21*a* is rotatably supported around the support portion 21*b* and is configured to be moved between a valve opened position illustrated by the solid line in FIG. 8 and a valve closed position illustrated by the imaginary line. Also, as illustrated in FIG. 11, the pilot valve 21*f* provided in the transmission arm member 21*a* constitutes a part of the discharge valve control valve 18 and functions to open and close the pilot valve port 18*c*. The pilot valve port 18*c* communicates with the pressure chamber 18*d* in the control valve main body portion 18*a*. Therefore, when the transmission arm member 21*a* is moved to the valve opened position, the pilot valve port 18*c* is opened, this leads to a decrease in pressure in the pressure chamber 18*d* of the discharge valve control valve 18, and the main valve body 18*b* of the discharge valve control valve 18 is thus opened.

Also, as illustrated in FIG. 8, the transmission arm member 21*a* extends up to the rear side of the engaged member 20*c*, and a release end 21*g* of the transmission arm member 21*a* is located to face the engaging member 20*b* with the engaged member 20*c* sandwiched therebetween. Therefore, when the transmission arm member 21*a* is moved from the valve closed position illustrated in the section (d) of FIG. 9 to the valve opened position illustrated in the section (e) of FIG. 9, the distal end portion of the engaging member 20*b* received by the opening 20*f* of the engaged member 20*c* is pushed out by the release end 21*g* of the transmission arm member 21*a*. In this manner, the engagement between the engaging member 20*b* and the engaged member 20*c* is released.

On the other hand, the water receiving portion 21*c* is connected to the other end portion of the transmission arm member 21*a* as illustrated in FIG. 5.

The water receiving portion 21*c* is a cup-shaped member that opens on the upper side and is configured such that flush water that has been branched from the rim water supply pipe 25 by the branching portion 25*a* and has flowed to the downcomer 25*b* flows into the water receiving portion 21*c*. Also, the bottom portion of the water receiving portion 21*c* is provided with a discharge hole 21*h*, and the flush water that has flowed into the water receiving portion 21*c* is drained from the discharge hole 21*h* into the reservoir tank 10. Here, the flow rate of the flush water that flows from the downcomer 25*b* into the water receiving portion 21*c* is higher than the flow rate of the flush water that flows out from the discharge hole 21*h*, and in a state in which the flush water flows in from the downcomer 25*b*, the water level of the flush water in the water receiving portion 21*c* increases.

The balance float 21*d* is a float attached to a lower side of the water receiving portion 21*c* via the connecting portion 21*e*. The balance float 21*d* is configured to receive a buoyant force from the flush water retained in the reservoir tank 10 and push the water receiving portion 21*c* upward. In a case in which the flush water is not retained in the water receiving portion 21*c*, the water receiving portion 21*c* is brought into a state in which the balance float 21*d* is pushed upward by the buoyant force. In this state, the transmission arm member 21*a* connected to the water receiving portion 21*c* has been moved to the valve closed position.

On the other hand, when the flush water flows from the downcomer 25*b* into the water receiving portion 21*c*, the weight of the water receiving portion 21*c* increases, and the balance float 21*d* is pushed downward by the water receiving portion 21*c*. When the weight of the water receiving portion 21*c* increases and overcomes the buoyant force acting on the balance float 21*d* due to the flush water flowing into the water receiving portion 21*c*, then the transmission arm member 21*a* is moved to the valve opened position. When the transmission arm member 21*a* is moved to the valve opened position, the pilot valve port 18*c* is opened, and the main valve body 18*b* of the discharge valve control valve 18 is thus opened.

Note that since the water receiving portion 21*c* is connected to the balance float 21*d* with a gap therebetween above the balance float 21*d* via the connecting portion 21*e*, the water receiving portion 21*c* is still located above the stopped water level $L_1$ in the reservoir tank 10 even in a state in which the flush water has flowed in and the position of the water receiving portion 21*c* has been lowered. Therefore, the water receiving portion 21*c* itself does not receive the buoyant force from the flush water in the reservoir tank 10, and the water receiving portion 21*c* can effectively push the balance float 21*d* downward by the flush water flowing thereinto.

Next, newly referring to FIG. 12, effects of the flush water tank device 4 according to the first embodiment of the present invention and a flush toilet apparatus 1 provided with the same will be described.

Figure 12:
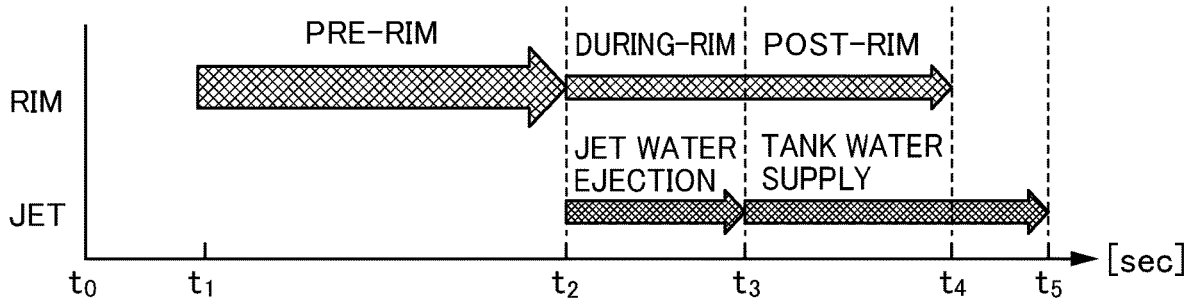
FIG. 12 is a time chart illustrating an example of a washing sequence performed by the flush water tank device according to the first embodiment of the present invention.

FIG. 12 is a time chart illustrating an example of a washing sequence performed by the flush water tank device 4 according to the first embodiment of the present invention.

First, in a toilet washing standby state at a clock time to in FIG. 12, the water level in the reservoir tank 10 is at the stopped water level $L_1$. In this state, the drive arm member 16*a* of the water supply valve driving mechanism 16 is at the stopping position, the transmission arm member 21*a* of the delay valve opening mechanism 21 is at the valve closed position, and thus, each of the pilot valve port 19*c* of the water supply control valve 19 and the pilot valve port 18*c* of the discharge valve control valve 18 is closed. Therefore, the main valve body 19*b* of the water supply control valve 19 is in the valve closed state, and the main valve body 18*b* of the discharge valve control valve 18 is also in the valve closed state.

Next, when the user operates the lever handle 8 (FIG. 1) at a clock time $t_1$ in FIG. 12, the drive arm member 16*a* of the water supply valve driving mechanism 16 is moved to the ejection position in conjunction with the operation. The holding mechanism main body portion 20*a* of the holding mechanism 20 connected to the drive arm member 16*a* and the biasing rod 17*c* of the biasing mechanism 17 are also pushed downward by the drive arm member 16*a* being moved to the ejection position. Also, the sloped surface 20*e* at the distal end of the engaging member 20*b* of the holding mechanism 20 abuts on the upper end of the engaged member 20*c* when the holding member main body portion 20*a* is pushed downward, and the engaging member 20*b* moves backward to the engagement released position (see the section (b) of FIG. 9). Furthermore, when the drive arm member 16*a* is moved to the ejection position, the engaging member 20*b* matches the opening 20*f* of the engaged member 20*c*, and the engaging member 20*b* projects to the inside of the opening 20*f* (see the section (c) of FIG. 9). In this manner, engagement is established between the engaging member 20*b* and the engaged member 20*c*.

On the other hand, the biasing mechanism 17 biases the holding mechanism main body portion 20*a* upward using the buoyant force acting on the biasing float 17*b*, and the holding mechanism main body portion 20*a* is kept at the pushed-down position through the engagement of the engaging member 20*b* with the engaged member 20*c*. In this manner, the holding mechanism 20 holds the drive arm member 16*a* of the water supply valve driving mechanism 16 that has been moved to the ejection position at the ejection position against the biasing force of the biasing mechanism 17 by the engaging member 20*b* establishing engagement with the engaged member 20*c*.

If the drive arm member 16*a* of the water supply valve driving mechanism 16 is moved to the ejection position, the pilot valve port 19*c* (FIG. 10) of the water supply control valve 19 is opened. In this manner, the pressure in the pressure chamber 19*d* inside the water supply valve main body portion 19*a* decreases, and the main valve body 19*b* is separated from a valve seat and is opened. When the water supply control valve 19 is opened, the tap water supplied from the water supply pipe 32 to the water supply control valve 19 via the water supply pipe branching portion 33 and the second branching pipe 33*b* flows into the rim water supply pipe 25 through the water supply control valve 19. The flush water that has flowed into the rim water supply pipe 25 is ejected from the rim spout port 2*d* (FIG. 2) of the flush toilet main body 2 and is used as "pre-rim" ejected water before water ejection from the jet spout port 2*b* is started, and washing of the bowl 2*a* is started with rim flush water. Also, a part of the flush water that has flowed into the rim water supply pipe 25 flows into the downcomer 25*b* (FIG. 5), and the flush water that has flowed into the downcomer 25*b* flows into the water receiving portion 21*c* of the delay valve opening mechanism 21 disposed below the downcomer 25*b*. In other words, the flush water that has flowed out from the water supply control valve 19 is branched and supplied to each of the rim spout port 2*d* and the water receiving portion 21*c* of the delay valve opening mechanism 21.

If the amount of flush water that has flowed in from the downcomer 25*b* and has been retained in the water receiving portion 21*c* exceeds a predetermined amount at a clock time $t_2$ in FIG. 12 after water ejection from the rim spout port 2*d* is started, the gravity working on the water receiving portion 21*c* overcomes the buoyant force acting on the balance float 21*d*, and the water receiving portion 21*c* is lowered. When the water receiving portion 21*c* is lowered, the transmission arm member 21*a* connected thereto is turned about the support portion 21*b*, and the transmission arm member 21*a* is moved from the valve closed position to the valve opened position. When the transmission arm member 21*a* is moved to the valve opened position, the pilot valve port 18*c* (FIG. 11) of the discharge valve control valve 18 is opened, the pressure in the pressure chamber 18*d* inside the control valve main body portion 18*a* thus decreases, and the main valve body 18*b* is opened. In other words, the discharge valve control valve 18 is opened with the water supply control valve 19 maintained in the valve opened state after the water supply control valve 19 is opened. Also, when the transmission arm member 21*a* is moved to the valve opened position, the holding of the drive arm member 16*a* achieved by the holding mechanism 20 is released as will be described later.

If the discharge valve control valve 18 is opened, the tap water supplied from the water supply pipe 32 to the discharge valve control valve 18 via the water supply pipe branching portion 33 and the first branching pipe 33*a* flows into the inlet pipe 23 (FIG. 5) through the discharge valve control valve 18. Furthermore, the flush water that has flowed into the inlet pipe 23 flows into the cylinder 14*a* of the discharge valve water pressure drive portion 14 and pushes the piston 14*b* (FIG. 4) upward. In this manner, the rod 15 connected to the piston 14*b* and the discharge valve 12 are also pulled upward, and the drain port 10*a* is opened.

In this manner, the delay valve opening mechanism 21 causes the discharge valve control valve 18 to open with a delay of predetermined time after water ejection from the rim spout port 2*d* is started and supplies the flush water to the discharge valve water pressure drive portion 14. Also, a part of the flush water that has flowed from the downcomer 25*b* into the water receiving portion 21*c*, that is, the flush water introduced via the water supply control valve 19 is used to open the discharge valve control valve 18. Furthermore, the discharge valve control valve 18 functions as a control valve for causing the discharge valve 12 to open.

The flush water retained in the reservoir tank 10 flows out through the drain port 10*a* by the drain port 10*a* being opened and is ejected as "jet ejected water" from the jet spout port 2*b* (FIG. 2) provided at the lower portion of the bowl 2*a*. The flush water ejected from the jet spout port 2*b* completely fills the water discharge trap pipe 2*e* extending from the lower portion of the bowl 2*a* and induces a siphon phenomenon. Through the siphon phenomenon, the retained water and solid waste in the bowl 2*a* are discharged through the water discharge trap pipe 2*e*. In this manner, the water ejection from the rim spout port 2*d* is continued as "during-rim" water ejection even when the flush water is being ejected from the jet spout port 2*b*. Therefore, the flush water is temporarily ejected from both the rim spout port 2*d* and the jet spout port 2*b* by the drain port 10*a* being opened.

In this manner, in the flush toilet apparatus 1 according to the present embodiment, the supply of the flush water from the rim spout port 2*d* is continued even during occurrence of the siphon phenomenon by the flush water drained from the jet spout port 2*b*. Therefore, it is possible to prevent an excessive decrease in retained water in the bowl 2*a* due to retained water drawing in through the siphon phenomenon, which leads to interruption of sealed water in the water discharge trap pipe 2*e*. When the sealed water in the water discharge trap pipe 2*e* is interrupted, there is a concern that odor flows backward from the water discharge trap pipe 2*e*. However, it is possible to prevent this in the present embodiment. Also, since the supply of the flush water from the rim spout port 2*d* is continued even during occurrence of the siphon phenomenon, the sealed water is not interrupted, and it is possible to continue the siphon phenomenon and thereby to prevent the siphon phenomenon from ending in the process.

On the other hand, when the piston 14*b* is pushed upward by the discharge valve water pressure drive portion 14, and in response with this, the rod 15 and the discharge valve 12 are pulled upward to predetermined positions, then the clutch mechanism 22 separates the lower rod 15*b* and the discharge valve 12 from the upper rod 15*a*. In this manner, the upper rod 15*a* is maintained to be pushed upward along with the piston 14*b* when the discharge valve control valve 18 is opened, while the lower rod 15*b* and the discharge valve 12 are lowered due to their own weights. However, the separated lower rod 15*b* establishes engagement with the engaging portion 26*b* of the discharge valve float mechanism 26, and lowering of the lower rod 15*b* and the discharge valve 12 are prevented. In this manner, the drain port 10*a* of the reservoir tank 10 is maintained to be opened even after the clutch mechanism 22 is separated, and water discharge from the reservoir tank 10 is continued.

Also, when the flush water flows from the inlet pipe 23 into the cylinder 14*a* of the discharge valve water pressure drive portion 14, and the piston 14*b* is pushed upward to the upper portion of the cylinder 14*a*, the flush water in the cylinder 14*a* flows out through the outlet pipe 24 (FIG. 5). Also, a part of water that has flowed from the inlet pipe 23 into the cylinder 14*a* flows out from the clearance 14*d* (FIG. 4) between the inner wall of the through-hole 14*f* of the cylinder 14*a* and the rod 15, and the water flows into the reservoir tank 10. On the other hand, a part of the flush water that has flowed out through the outlet pipe 24 flows into the overflow pipe 10*b*, and remaining flush water flows into the reservoir tank 10. In other words, a part of the flush water that has flowed out of the discharge valve water pressure drive portion 14 flows into the reservoir tank 10, and the remaining flush water that has flowed into the overflow pipe 10*b* bypasses the discharge valve 12 and flows from the jet spout port 2*b* into the flush toilet main body. Note that since the flow rate of the flush water flowing into the reservoir tank 10 through the outlet pipe 24 is lower than the flow rate of the flush water drained from the drain port 10*a* by the discharge valve 12 being opened, the water level in the reservoir tank 10 is lowered in this state.

On the other hand, when the transmission arm member 21*a* is moved to the valve opened position, the release end 21*g* (FIG. 8) of the transmission arm member 21*a* pushes back (the section (d) to the section (e) of FIG. 9) the engaging member 20*b* that faces the release end 21*g* with the engaged member 20*c* of the holding member 20 sandwiched therebetween and releases the engagement between the engaging member 20*b* and the engaged member 20*c*. When the engagement between the engaging member 20*b* and the engaged member 20*c* is released, the holding mechanism main body portion 20*a* of the holding mechanism 20 is moved upward by the biasing force of the biasing mechanism 17. In other words, the biasing float 17*b* of the biasing mechanism 17 receives the buoyant force from the flush water retained in the small tank 17*a* and causes the biasing rod 17*c* attached to the biasing float 17*b* to move upward. In this manner, the holding mechanism main body portion 20*a* and the drive arm member 16*a* connected to the biasing rod 17*c* are moved. In this manner, the delay valve opening mechanism 21 releases the holding state of the drive arm member 16*a* of the water supply valve driving mechanism 16 using the weight of the flush water that has flowed out from the water supply control valve 19 and have been retained in the water receiving portion 21*c*. In other words, the delay valve opening mechanism 21 releases the holding of the drive arm member 16*a* on the basis of the amount of the flush water that has flowed out from the water supply control valve 19. In this manner, the drive arm member 16*a* of the water supply valve driving mechanism 16 starts to move from the ejection position to the stopping position. Also, the biasing force of the biasing mechanism 17 is relatively weak, and the biasing rod 17*c* slightly moves upward after the engagement between the engaging member 20*b* and the engaged member 20*c* is released.

Then, when the water level in the reservoir tank 10 is lowered to a predetermined water level by the flush water in the reservoir tank 10 being drained from the drain port 10*a*, the float portion 26*a* of the discharge valve float mechanism 26 is lowered, and this causes the engaging portion 26*b* to move. In this manner, the engagement between the lower rod 15*b* and the engaging portion 26*b* is released, and the lower rod 15*b* and the discharge valve 12 start to move downward again. Then, the drain port 10*a* of the reservoir tank 10 is closed by the discharge valve 12 at a clock time $t_3$ in FIG. 12, and the water ejection of the flush water, which has flowed out from the drain port 10*a*, from the jet spout port 2*b* is stopped.

Furthermore, since the discharge valve control valve 18 is in the valve opened state even after the drain port 10*a* is closed, the water supplied from the water supply pipe 32 flows into the discharge valve water pressure drive portion 14 and flows out to the outlet pipe 24 (FIG. 5). Since a most part of the flush water that has flowed out from the outlet pipe 24 flows into the reservoir tank 10 through the second downcomer 24*c*, the water level in the reservoir tank 10 increases. Also, a part of the remaining flush water that has flowed out from the outlet pipe 24 flows into the overflow pipe 10*b* through the first downcomer 24*b*. Therefore, the flush water that has flowed into the overflow pipe 10*b* flows into the bowl 2*a* through the jet spout port 2*b* at a low flow rate even after the drain port 10*a* is closed, and the flush water that has flowed into the bowl 2*a* is used as refill water.

Furthermore, the drive arm member 16*a* of the water supply valve driving mechanism 16 that has been moved by the biasing rod 17*c* of the biasing mechanism 17 reaches the stopping position at a clock time $t_4$ after the water ejection from the jet spout port 2*b* is stopped at the clock time $t_3$ in FIG. 12. The pilot valve port 19*c* (FIG. 10) of the water supply control valve 19 is closed by the drive arm member 16*a* reaching the stopping position. In this manner, the main valve body 19*b* of the water supply control valve 19 is closed, and the water ejection from the rim spout port 2*d* of the flush toilet main body 2 is stopped. Note that after the jet water ejection is ended, water ejection from the rim spout port 2*d* is performed as "post-rim" water ejection, and the flush water ejected from the rim spout port 2*d* also flows into the bowl 2*a* and is used as refill water. Also, the discharge valve control valve 18 is maintained in the valve opened state even after the water supply control valve 19 is closed, and the flush water that has flowed from the first downcomer 24*b* into the overflow pipe 10*b* through the discharge valve water pressure drive portion 14 is used as a refill for the bowl 2*a*.

Note that in the present embodiment, a part of the remaining flush water that has flowed out from the outlet pipe 24 flows into the overflow pipe 10*b* through the first downcomer 24*b*, and this is used as a refill for the bowl 2*a*. In this regard, it is also possible to adjust water ejection time from the rim spout port 2*d* of the flush toilet main body 2, for example, and to use the flush water ejected from the rim spout port 2*d* after the jet water ejection is ended as a refill for the bowl 2*a* in a modification example.

On the other hand, when the water supply control valve 19 is closed, the flush water flowing into the water receiving portion 21*c* of the delay valve opening mechanism 21 through the downcomer 25*b* branched from the rim water supply pipe 25 (FIG. 5) is also stopped. Also, the water receiving portion 21*c* is provided with the discharge hole 21*h* (FIG. 5) as described above, and the flush water that has flowed into the water receiving portion 21*c* is drained from the discharge hole 21*h* into the reservoir tank 10. Therefore, of the flowing-in when the flush water from the downcomer 25*b* is stopped, the amount of flush water retained in the water receiving portion 21*c* decreases little by little.

If the amount of flush water in the water receiving portion 21*c* decreases to a predetermined amount at a clock time $t_5$ in FIG. 12, the water receiving portion 21*c* moves upward due to the buoyant force acting on the balance float 21*d*. In this manner, the transmission arm member 21*a* (FIG. 5) connected to the water receiving portion 21*c* is turned about the support portion 21*b* from the valve opened position to the valve closed position. When the transmission arm member 21*a* is moved to the valve closed position, the pilot valve port 18*c* (FIG. 11) of the discharge valve control valve 18 is closed. In this manner, the pressure in the pressure chamber 18*d* inside the control valve main body portion 18*a* increases, the main valve body 18*b* is closed, and the discharge valve control valve 18 is brought into a valve closed state. As described above, the water supply to the reservoir tank 10 is stopped. Also, the water level in the reservoir tank 10 at this time is the stopped water level $L_1$.

On the other hand, when the supply of water to the discharge valve water pressure drive portion 14 is stopped by the discharge valve control valve 18 being closed, the piston 14*b* (FIG. 4) of the discharge valve water pressure drive portion 14 is pushed downward by the biasing force of the spring 14*c*. When the upper rod 15*a* is pushed downward along with the piston 14*b*, the upper rod 15*a* and the lower rod 15*b* that have been separated by the clutch mechanism 22 are connected to each other again. Therefore, both the upper rod 15*a* and the lower rod 15*b* are pulled upward by the piston 14*b* when the toilet washing is executed next time. As described above, one-time toilet washing is ended, and the flush toilet apparatus 1 returns to the toilet washing standby state.

According to the flush water tank device 4 in the first embodiment of the present invention, the discharge valve water pressure drive portion 14 drives the discharge valve 12 with the water supply pressure of the flush water supplied from the tap water C that is a water supply source, and it is thus possible to drive the discharge valve 12 with a sufficient drive force. Also, the delay valve opening mechanism 21 supplies the flush water to the discharge valve water pressure drive portion 14 and causes the discharge valve 12 to open with a delay of predetermined time after water ejection from the rim spout port 2*d* is started, it is possible to cause the jet spout port 2*b* to start water ejection with a delay after the water ejection from the rim spout port 2*d* is started and thereby to effectively wash the flush toilet main body 2.

Also, according to the flush water tank device 4 in the present embodiment, the transmission arm member 21*a* that is the second on-off valve driving mechanism causes the discharge valve control valve 18 to open when the weight of the water receiving portion 21*c* increases due to the flush water flowing into the water receiving portion 21*c* and overcomes the buoyant force acting on the balance float 21*d*, and as a result, the discharge valve 12 is opened. Therefore, it is possible to freely set the time before the discharge valve control valve 18 is opened depending on the configurations of the water receiving portion 21*c* and the balance float 21*d*. Additionally, it is also possible to reduce the size of the water receiving portion 21*c* by setting a small buoyant force to act on the balance float 21*d*.

Furthermore, according to the flush water tank device 4 in the present embodiment, it is possible to freely set the flow rate of the flush water flowing into the water receiving portion 21*c* depending on the design of the branching portion 25*a* provided in the rim water supply pipe 25 that is the spout port water supply pipe and to freely set the delay time before the discharge valve 12 is opened.

Also, according to the flush water tank device 4 in the present embodiment, the water receiving portion 21*c* is provided with the discharge hole 21*h* that drains the flush water in the water receiving portion 21*c* at the lower flow rate than the flow rate of the flush water flowing into the water receiving portion 21*c*. Therefore, the weight of the water receiving portion 21*c* increases when the flush water flows thereinto and can overcome the buoyant force acting on the balance float 21*d*. Also, the flush water in the water receiving portion 21*c* is discharged after the flowing-in of the flush water is stopped, and it is possible to automatically return to the initial state.

Furthermore, according to the flush water tank device 4 in the present embodiment, the water receiving portion 21*c* is disposed above the water surface at the stopped water level $L_1$ in the reservoir tank 10, the buoyant force does not act on the water receiving portion 21*c* itself, and it is possible to effectively use the weight of the flush water retained in the water receiving portion 21*c*.

Also, according to the flush water tank device 4 in the present embodiment, the water receiving portion 21*c* and the balance float 21*d* are connected with a gap therebetween by the connecting portion 21*e*, and it is thus possible to freely design the positional relationship between the water receiving portion 21*c* and the balance float 21*d*.

Furthermore, according to the flush water tank device 4 in the present embodiment, the transmission arm member 21*a* causes the pilot valve 21*f* of the discharge valve control valve 18 to open and close on the basis of the gravity acting on the water receiving portion 21*c* and the buoyant force acting on the balance float 21*d*, it is possible to cause the discharge valve control valve 18 to open and close with a small force acting on the water receiving portion 21*c* and the balance float 21*d*. Therefore, it is possible to widen the degree of freedom in designing the water receiving portion 21*c* and the balance float 21*d*.

Next, a flush water tank device according to a second embodiment of the present invention will be described with reference to FIGS. 13 to 15.

The flush water tank device according to the present embodiment is different from that in the aforementioned first embodiment of the present invention in a mechanism of opening and closing a water supply control valve. Therefore, only parts of the second embodiment of the present invention that are different from those in the first embodiment will be described herein, the same reference signs as those in the first embodiment will be applied to similar configurations, and description thereof will be omitted. Also, description of effects and advantages of the second embodiment of the present, invention that are similar to those of the first embodiment will also be omitted.

Figure 13:
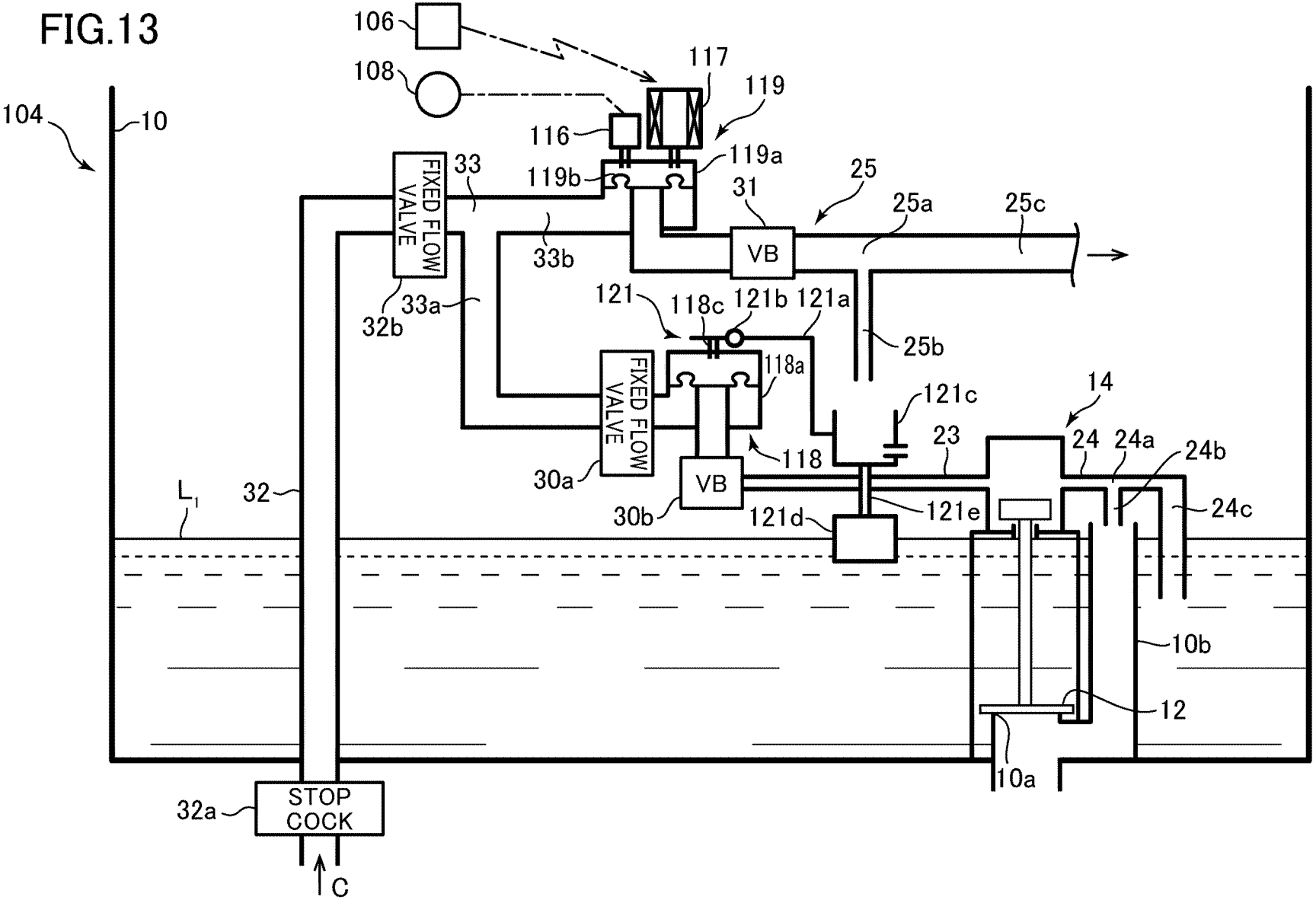
FIG. 13 is a sectional view illustrating an overview configuration of a flush water tank device according to a second embodiment of the present invention.

FIG. 13 is a sectional view illustrating an overview configuration of the flush water tank device according to the second embodiment of the present invention. FIG. 14 is a sectional view illustrating an internal structure of a water supply control valve. FIG. 15 is a sectional view illustrating an internal structure of a discharge valve control valve.

As illustrated in FIG. 13, a flush water tank device 104 according to the second embodiment of the present invention includes an electromagnetic valve 117 that opens and closes a water supply control valve 119 that is a first on-off valve on the basis of a user's operation performed on a remote controller 106 and a manual valve opening mechanism 116 that opens the water supply control valve 119 on the basis of a user's manual operation during power outage. Furthermore, the flush water tank device 104 includes a discharge valve control valve 118 that is a second on-off valve for controlling water supply to a discharge valve water pressure drive portion 14 and a delay valve opening mechanism 121 that causes the discharge valve control valve 118 to open with a delay of predetermined time after water ejection from a rim spout port 2*d* is started using a part of flush water introduced via the water supply control valve 119 and supplies the flush water to the discharge valve water pressure drive portion 14.

Figure 14:
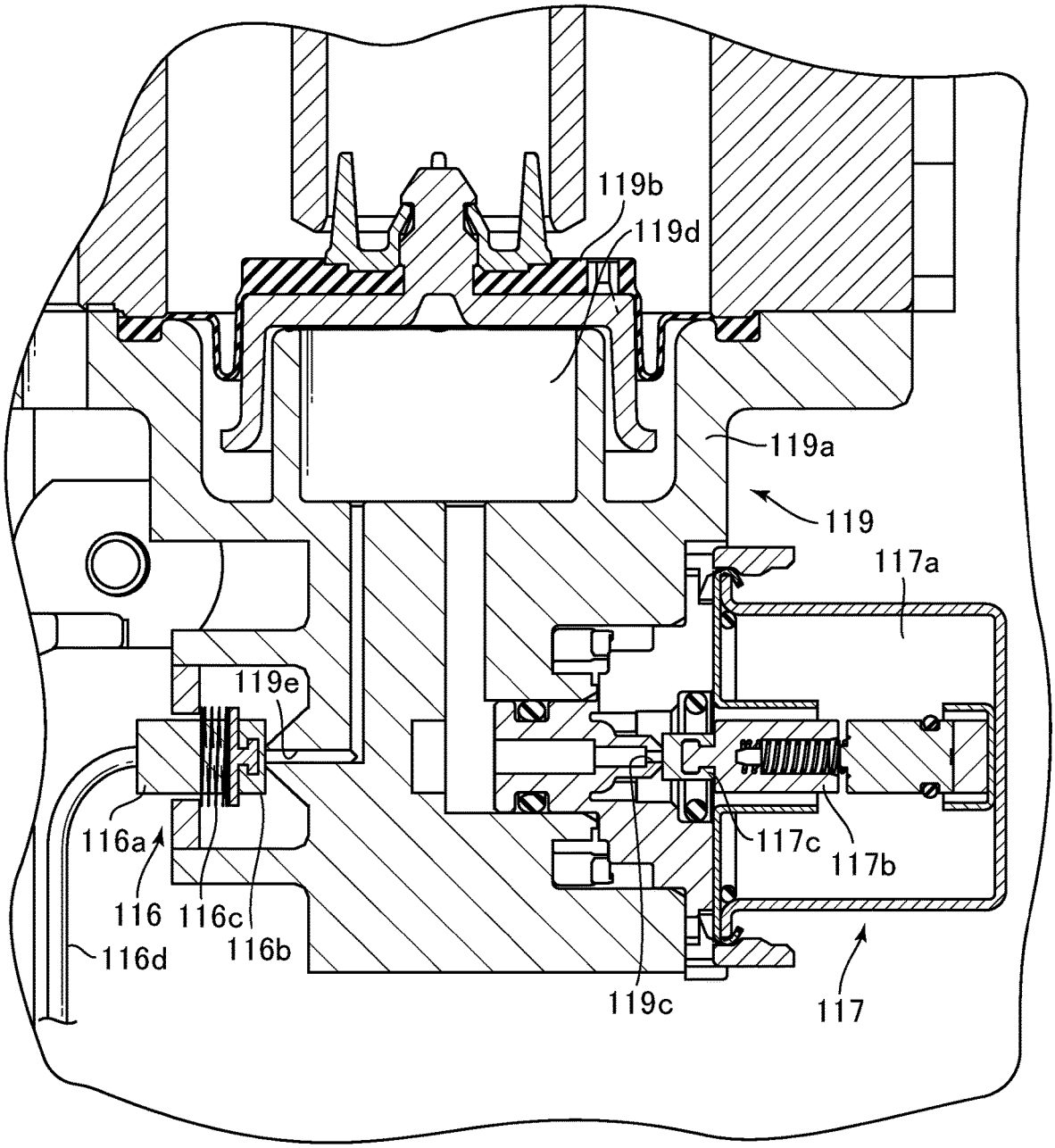
FIG. 14 is a sectional view illustrating an internal structure of a water supply control valve included in the flush water tank device according to the second embodiment of the present invention.

As illustrated in FIG. 14, the water supply control valve 119 includes a water supply valve main body portion 119*a*, a main valve body 119*b* that is disposed in the water supply valve main body portion 119*a*, a pressure chamber 119*d* that is formed to be adjacent to the main valve body 119*b*, and a pilot valve port 119*c* that communicates with the pressure chamber 119*d*. Moreover, an electromagnetic valve 117 is attached to the water supply control valve 119, and a pilot valve port 119*c* of the water supply control valve 119 is opened and closed by the electromagnetic valve 117. Then, the pressure in the pressure chamber 119*d* is controlled by opening or closing the pilot valve port 119*c*, and the main valve body 119*b* of the water supply control valve 119 is opened or closed.

The electromagnetic valve 117 includes a drive coil 117*a*, a plunger 117*b* that is driven by the drive coil 117*a*, and a pilot valve body 117*c* that is attached to the plunger 117*b*. When the user performs a washing operation through the remote controller 106, then a current flows through the drive coil 117*a* of the electromagnetic valve 117, and the plunger 117*b* moves backward. In this manner, the pilot valve body 117*c* attached to the plunger 117*b* is separated from the pilot valve port 119*c*, and the pilot valve port 119*c* is opened. As a result, the pressure in the pressure chamber 119*d* of the water supply control valve 119 decreases, and the main valve body 119*b* is opened.

Note that a latching solenoid is employed as the electromagnetic valve 117 in the present embodiment, and the state in which the plunger 117*b* has moved backward is maintained even when the current flowing through the drive coil 117*a* is stopped. Furthermore, the plunger 117*b* moves forward by causing a current in a reverse direction to flow through the drive coil 117*a*, and the pilot valve port 119*c* is closed by the pilot valve body 117*c*.

Moreover, the manual valve opening mechanism 116 is attached to the water supply control valve 119, and the user can manually open the water supply control valve 119 through the manual valve opening mechanism 116 at the time of power outage. The manual valve opening mechanism 116 includes a movable member 116*a*, a pilot valve body 116*b* that is attached to the movable member 116*a*, a coil spring 116*c* that biases the pilot valve body 116*b* toward the pilot valve port, and a wire 116*d* that is attached to the movable member 116*a*. A grip ring 108 (FIG. 13) that is a manual operation unit is attached to the distal end of the wire 116*d* and is configured to be able to cause the movable member 116*a* to move backward by the user holding the grip ring 108 and pulling the wire 116*d*.

On the other hand, the water supply control valve 119 is provided with a pilot valve port during power outage 119*e*, and the pilot valve port during power outage 119*e* is typically closed by the pilot valve body 116*b* of the manual valve opening mechanism 116. In a case in which the electromagnetic valve 117 does not operate during power outage or the like, the user manually pulls the grip ring 108 (FIG. 13) and causes the movable member 116*a* to move backward. In this manner, the pilot valve port during power outage 119*e* that, has been closed by the pilot valve body 116*b* opened, and as a result, the pressure in the pressure chamber 119*d* of the water supply control valve 119 decreases, and the main valve body 119*b* is opened. In this manner, the water supply control valve 119 is configured such that the main valve body 119*b* thereof is opened by opening any one of the pilot valve port 119*c* and the pilot valve port during power outage 119*e*.

Figure 15:
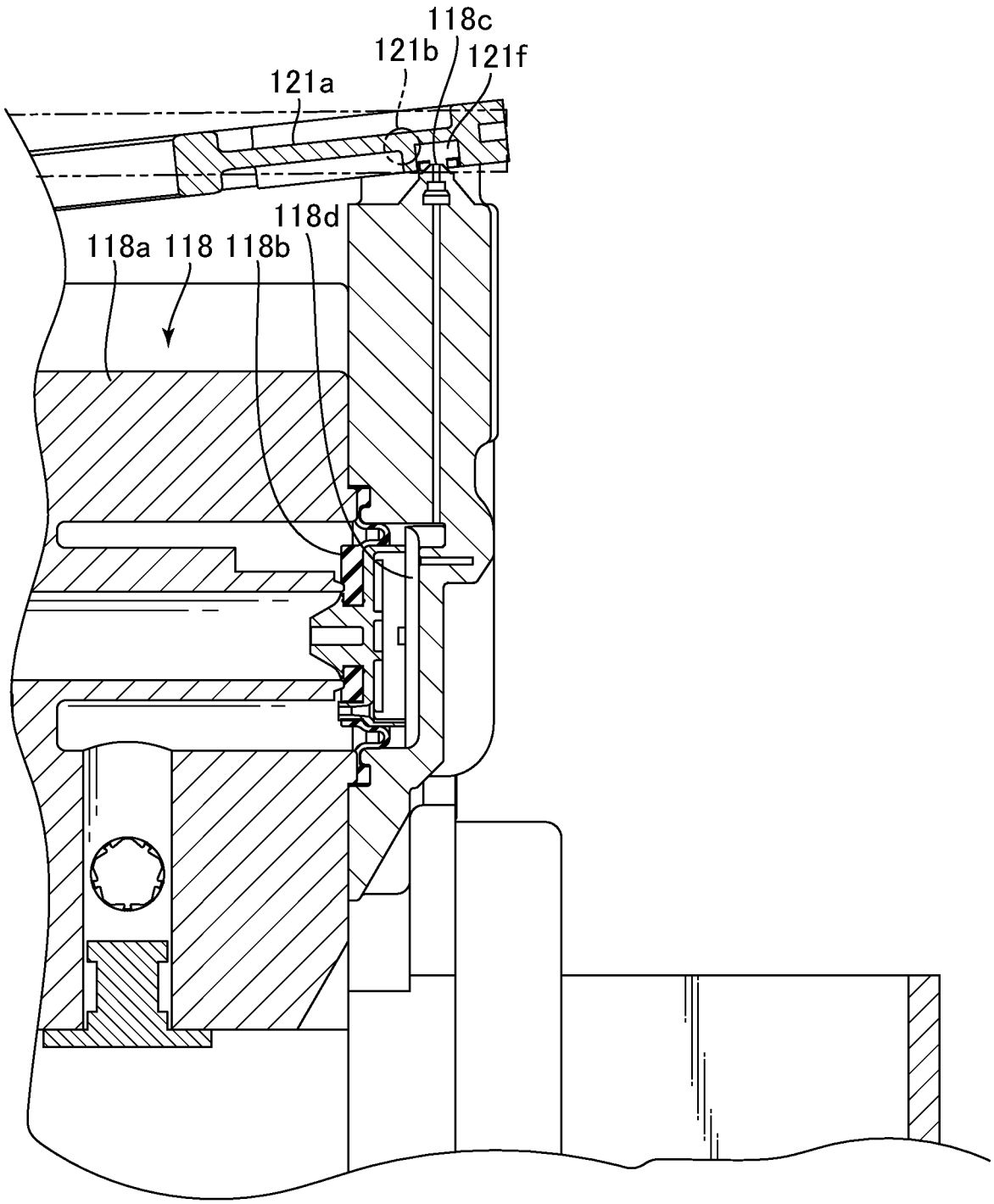
FIG. 15 is a sectional view illustrating an internal structure of a discharge valve control valve included in the flush water tank device according to the second embodiment of the present invention.

Next, as illustrated in FIG. 15, the discharge valve control valve 118 includes a control valve main body portion 118*a*, a main valve body 118*b* that is disposed in the control valve main body portion 118*a*, a pressure chamber 118*d* that is formed to be adjacent to the main valve body 118*b*, and a pilot valve port 118*c* that communicates with the pressure chamber 118*d*. Moreover, the delay valve opening mechanism 121 is attached to the discharge valve control valve 118.

As illustrated in FIG. 13, the delay valve opening mechanism 121 includes a transmission arm member 121*a* that is a second on-off valve driving mechanism formed substantially into an L shape, a support portion 121*b* that rotatably supports the transmission arm member 121*a*, a water receiving portion 121*c* that is attached to one end portion of the transmission arm member 121*a*, a balance float 121*d* that is provided on the lower side of the water receiving portion 121*c*, and a connecting portion 121*e* that connects the water receiving portion 121*c* to the balance float 121*d*.

The transmission arm member 121*a* is supported such that it is rotatable about the support portion 121*b* and is configured to be moved between a valve opened position illustrated by the solid line in FIG. 15 and a valve closed position illustrated by the imaginary line. Also, a pilot valve 121*f* provided in the transmission arm member 121*a* constitutes a part of the discharge valve control valve 118 as illustrated in FIG. 15 and functions to open and close the pilot valve port 118*c*. The pilot valve port 118*c* communicates with the pressure chamber 118*d* in the control valve main body portion 118*a*. Therefore, when the transmission arm member 121*a* is moved to the valve opened position, the pilot valve port 118*c* is opened, the pressure in the pressure chamber 118*d* of the discharge valve control valve 118 thus decreases, and the main valve body 118*b* of the discharge valve control valve 118 is thus opened.

On the other hand, the water receiving portion 121*c* is connected to the other end portion of the transmission arm member 121*a* as illustrated in FIG. 13.

The water receiving portion 121*c* is a cup-shaped member that opens on the upper side and is configured such that flush water that has been branched from the rim water supply pipe 25 by the branching portion 25*a* and has flowed to the downcomer 25*b* flows into the water receiving portion 121*c*. Also, a bottom portion of the water receiving portion 121*c* is provided with a discharge hole (not illustrated), and the flush water that has flowed into the water receiving portion 121*c* is drained from the discharge hole into the reservoir tank 10.

The balance float 121*d* is a float attached to the lower side of the water receiving portion 121*c* via the connecting portion 121*e*. The balance float 121*d* is configured to receive the buoyant force from the flush water retained in the reservoir tank 10 and push the water receiving portion 121*c* upward. In a case in which the flush water is not retained in the water receiving portion 121*c*, the water receiving portion 121*c* is brought, into a state in which it has been pushed upward by the buoyant force exerted on the balance float 121*d*. In this state, the transmission arm member 121*a* connected to the water receiving portion 121*c* has been moved to the valve closed position.

On the other hand, when the flush water flows from the downcomer 25*b* into the water receiving portion 121*c*, the weight of the water receiving portion 121*c* increases, and the balance float 121*d* is pushed downward by the water receiving portion 121*c*. When the weight of the water receiving portion 121*c* increases by the flush water flowing into the water receiving portion 121*c* and overcomes the buoyant force acting on the balance float 121*d*, the transmission arm member 121*a* is moved to the valve opened position. When the transmission arm member 121*a* is moved to the valve opened position, the pilot valve port 118*c* is opened, and the main valve body 118*b* of the discharge valve control valve 118 is thus opened.

Next, effects of the flush water tank device 104 according to the second embodiment of the present invention will be described.

First of all, the water level in the reservoir tank 10 is the stopped water level $L_1$ in the standby state of the flush water tank device 104. In this state, the pilot valve body 117*c* of the electromagnetic valve 117 has closed the pilot valve port 119*c* of the water supply control valve 119, and the pilot valve body 116*b* of the manual valve opening mechanism 116 has closed the pilot valve port during power outage 119*e* of the water supply control valve 119. Also, the pilot valve 121*f* of the delay valve opening mechanism 121 has closed the pilot valve port 118*c* of the discharge valve control valve 118. Therefore, the main valve body 119*b* of the water supply control valve 119 is in the valve closed state, and the main valve body 118*b* of the discharge valve control valve 118 is also in the valve closed state.

Next, when the user operates the remote controller 106 (FIG. 13), a controller (not illustrated) sends a control signal to the electromagnetic valve 117, causes the pilot valve body 117*c* to move, and causes the pilot valve port 119*c* to open. In this manner, the main valve body 119*b* of the water supply control valve 119 is separated from the valve seat and is opened. When the water supply control valve 119 is opened, tap water supplied from the water supply pipe 32 flows into the rim water supply pipe 25 through the water supply control valve 119. The flush water that has flowed into the rim water supply pipe 25 is ejected from the rim spout port 2*d* (FIG. 2) of the flush toilet main body 2, and washing of the bowl 2*a* with the rim flush water is started. Also, a part of the flush water that has flowed into the rim water supply pipe 25 flows into the downcomer 25*b* (FIG. 13), and the flush water that has flowed into the downcomer 25*b* flows into the water receiving portion 121*c* of the delay valve opening mechanism 121 disposed on the lower side of the downcomer 25*b*. In other words, the flush water that has flowed out from the water supply control valve 119 is branched and is supplied to each of the rim spout port 2*d* and the water receiving portion 121*c* of the delay valve opening mechanism 121.

If the amount of flush water that has flowed in from the downcomer 25*b* and has been retained in the water receiving portion 121*c* after water ejection from the rim spout port 2*d* is started exceeds a predetermined amount, the gravity working on the water receiving portion 121*c* overcomes the buoyant force acting on the balance float 121*d*, and the water receiving portion 121*c* is lowered. When the water receiving portion 121*c* is lowered, the transmission arm member 121*a* connected thereto is turned about the support portion 121*b*, and the transmission arm member 121*a* is moved from the valve closed position (the imaginary line in FIG. 15) to the valve opened position (the solid line in FIG. 15). Since the pilot valve port 118*c* (FIG. 15) of the discharge valve control valve 118 is opened in this manner, the main valve body 18*b* is opened. In other words, the discharge valve control valve 118 is opened with the valve opened state of the water supply control valve 119 maintained after the water supply control valve 119 is opened.

If the discharge valve control valve 118 is opened, the tap water supplied from the water supply pipe 32 flows into the inlet pipe 23 (FIG. 13) through the discharge valve control valve 118. Moreover, the flush water that has flowed into the inlet pipe 23 is supplied to the discharge valve water pressure drive portion 14 and pulls up the discharge valve 12. In this manner, the drain port 10*a* is opened.

In this manner, the delay valve opening mechanism 121 causes the discharge valve control valve 118 to be opened with a delay of predetermined time after water ejection from the rim spout port 2*d* is started and supplies the flush water to the discharge valve water pressure drive portion 14. Also, a part of the flush water that has flowed from the downcomer 25*b* into the water receiving portion 121*c*, that is, the flush water introduced via the water supply control valve 119 is used to open the discharge valve control valve 118. Moreover, the discharge valve control valve 118 functions as a control valve for causing the discharge valve 12 to open.

The flush water retained in the reservoir tank 10 flows out through the drain port 10*a* and is ejected from the jet spout port 2*b* (FIG. 2) provided at the lower portion of the bowl 2*a* by the drain port 10*a* being opened. In this manner, the flush water is temporarily ejected from both the rim spout port 2*d* and the jet spout port 2*b* by the drain port 10*a* being opened.

Also, the flush water supplied from the inlet pipe 23 to the discharge valve water pressure drive portion 14 flows out through the outlet pipe 24 (FIG. 13), a part of the flush water that has flowed out flows into the overflow pipe 10*b*, and the remaining flush water flows into the reservoir tank 10.

If the water level in the reservoir tank 10 is lowered to a predetermined water level by the flush water in the reservoir tank 10 being drained from the drain port 10*a*, then the discharge valve 12 starts to move downward. Thereafter, the drain port 10*a* of the reservoir tank 10 is closed by the discharge valve 12, and water ejection of the flush water, which has flowed out from the drain port 10*a*, from the jet spout, port 2*b* is stopped.

Moreover, since the discharge valve control valve 118 is in the valve opened state even after the drain port 10*a* is closed, the water supplied from the water supply pipe 32 flows into the discharge valve water pressure drive portion 14 and flows out to the outlet pipe 24 (FIG. 13). Since a most part of the flush water that has flowed out from the outlet pipe 24 flows into the reservoir tank 10 through the second downcomer 24*c*, the water level in the reservoir tank 10 increases. Also, a part of remaining flush water that has flowed out from the outlet pipe 24 flows into the overflow pipe 10*b* through the first downcomer 24*b*.

Further, the controller (not illustrate) sends a control signal to the electromagnetic valve 117, causes the pilot valve body 117*c* to move, and causes the pilot valve port 119*c* to be closed after water ejection from the jet spout port 2*b* is stopped. In this manner, the main valve, body 119*b* of the water supply control valve 119 is seated in the valve seat, and the water supply control valve 119 is closed. In other words, the controller (not illustrated) sends a control signal to the electromagnetic valve 117 again to cause the water supply control valve 119 to be closed after a predetermined time after sending a control signal to the electromagnetic valve 117 to cause the water supply control valve 119 to be opened. When the water supply control valve 119 is closed, water ejection from the rim spout port 2*d* is stopped. Note that the discharge valve control valve 118 is maintained in the valve opened state even after the water supply control valve 119 is closed.

On the other hand, when the water supply control valve 119 is closed, the flush water that has flowed into the water receiving portion 121*c* of the delay valve opening mechanism 121 through the downcomer 25*b* branched from the rim water supply pipe 25 (FIG. 13) is also stopped. Also, the water receiving portion 121*c* is provided with the discharge hole (not illustrated) as described above, and the flush water that has flowed into the water receiving portion 121*c* is drained from the discharge hole into the reservoir tank 10. Therefore, when the flowing-in of the flush water from the downcomer 25*b* is stopped, the amount of flush water retained in the water receiving portion 121*c* decreases little by little.

If the amount of flush water in the water receiving portion 121*c* decreases to the predetermined amount, the water receiving portion 121*c* moves upward by the buoyant force acting on the balance float 121*d*. In this manner, the transmission arm member 121*a* (FIG. 13) connected to the water receiving portion 121*c* is turned about the support portion

121*b* from the valve opened position to the valve closed position. When the transmission arm member 121*a* is moved to the valve closed position, the pilot valve port 118*c* (FIG. 15) of the discharge valve control valve 118 is closed. In this manner, the discharge valve control valve 118 is brought into the valve closed state. As described above, water supply to the reservoir tank 10 is stopped. As described above, one-time toilet washing is ended, and the flush toilet apparatus returns to the toilet washing standby state.

On the other hand, in a case in which it is not possible to cause the electromagnetic valve 117 to operate due to power outage or the like, the user causes the pilot valve body 116*b* (FIG. 14) of the manual valve opening mechanism 116 to move backward by pulling the grip ring 108 (FIG. 13). In this manner, the pilot valve port during power outage 119*e* of the water supply control valve 119 is opened, the pressure in the pressure chamber 119*d* decreases, and the main valve body 119*b* is opened. As a result, water ejection from the rim spout port 2*d* of the flush toilet main body 2 is started. In this manner, the effects of the flush water tank device 104 after the water supply control valve 119 is opened through a user's manual operation are similar to those in the case in which the water supply control valve 119 is opened by the electromagnetic valve 117.

In other words, after the water supply control valve 119 is opened, the delay valve opening mechanism 121 causes the discharge valve control valve 181 to be opened with a delay. When the discharge valve control valve 118 is opened, the discharge valve water pressure drive portion 14 operates, the discharge valve 12 is opened, and the flush water retained in the reservoir tank 10 is ejected from the jet spout port 2*b* of the flush toilet main body 2. When the user stops pulling the grip ring 108 after the flush water is ejected from the jet spout port 2*b*, the pilot valve body 116*b* closes the pilot valve port during power outage 119*e* of the water supply control valve 119 with the biasing force of the coil spring 116*c* (FIG. 14) of the manual valve opening mechanism 116. In this manner, the pressure in the pressure chamber 119*d* of the water supply control valve 119 increases, and the main valve body 119*b* is closed. Thereafter, the discharge valve 12 is closed, and the pilot valve 121*f* (FIG. 15) of the delay valve opening mechanism 121 causes the pilot valve port 118*c* of the discharge valve control valve 118 to be closed. As a result, the discharge valve control valve 119 is closed, and the flush water tank device 104 returns to the standby state.

According to the flush water tank device 104 in the second embodiment of the present invention, it is possible to cause the discharge valve control valve 118 to be opened with a delay and to cause the discharge valve water pressure drive portion 14 to open the discharge valve 12 merely by the electromagnetic valve 117 opening the water supply control valve 119. Also, in a case in which it is not possible to cause the electromagnetic valve 117 to open the water supply control valve 119 due to power outage or the like, it is possible to cause the water supply control valve 119 to be opened merely by the user to manually operating the grip ring 108. Furthermore, it is possible to cause the discharge valve control valve 119 to be opened with a delay and to cause the discharge valve 12 to be opened in this case as well.

Although the embodiments of the present invention have been described hitherto, various modifications can be added to the aforementioned embodiments. For example, although the rim spout port 2*d* that causes the flush water to be ejected along the wall surface of the rim 2*c* at the upper end of the bowl 2*a* is provided as the upper spout port in the aforementioned embodiments, it is possible to use, as the upper spout port, various spout ports provided above the retained water surface W of the flush toilet main body 2. Moreover, although the jet spout port 2*b* provided at the bottom portion of the bowl 2*a* to face the inlet of the water discharge trap pipe 2*e* is provided at the lower spout port in the aforementioned embodiments, it is possible to use, as the lower spout port, various spot ports provided below the retained water surface W of the flush toilet main body 2.

Also, in the aforementioned embodiments of the present invention, the delay valve opening mechanism includes the water receiving portion and the balance float, and the transmission arm member that is the second on-off valve driving mechanism is caused to operate by the weight of the water receiving portion overcoming the buoyant force of the balance float. In this regard, the delay valve opening mechanism may not include the balance float in a modification example. In other words, it is also possible to configure the present invention such that the water receiving portion is supported such that it is rotatable about a predetermined axial line, and when a predetermined amount or more flush water is retained in the water receiving portion, the water receiving portion is turned about the axial line, and the transmission arm member is operated. As another configuration, an arbitrary mechanism that causes the discharge valve control valve to be opened with a delay of predetermined time after water ejection from the rim spout port is started using a part of flush water introduced via the water supply control valve and supplies the flush water to the discharge valve water pressure drive portion can be used as the delay valve opening mechanism.

REFERENCE SIGNS LIST

1 Flush toilet apparatus
2 Flush toilet main body
2*a* Bowl
2*b* Jet spout port (lower spout port)
2*c* Rim
2*d* Rim spout port (upper spout port)
2*e* Water discharge trap pipe
4 Flush water tank device
8 Lever handle
10 Reservoir tank (flush water tank main body)
10*a* Drain port
10*b* Overflow pipe
12 Discharge valve
14 Discharge valve water pressure drive portion (water pressure driving mechanism)
14*a* Cylinder
14*b* Piston
14*c* Spring
14*d* Clearance
14*e* Packing
14*f* Through-hole
14*g* Frame
15 Rod
15*a* Upper rod
15*b* Lower rod
16 Water supply valve driving mechanism (first on-off valve driving mechanism)
16*a* Drive arm member
16*b* Support portion
16*c* Pilot valve portion
17 Biasing mechanism
17*a* Small tank
17*b* Biasing float

17*c* Biasing rod
18 Discharge valve control valve (second on-off valve)
18*a* Control valve main body portion
18*b* Main valve body (diaphragm)
18*c* Pilot valve port
18*d* Pressure chamber
19 Water supply control valve (first on-off valve)
19*a* Water supply valve main body portion
19*b* Main valve body
19*c* Pilot valve port
19*d* Pressure chamber
20 Holding mechanism
20*a* Holding mechanism main body portion
20*b* Engaging member
20*c* Engaged member
20*d* Spring
20*e* Sloped surface
20*f* Opening
21 Delay valve opening mechanism
21*a* Transmission arm member (second on-off valve driving mechanism)
21*b* Support portion
21*c* Water receiving portion
21*d* Balance float
21*e* Connecting portion
21*f* Pilot valve
21*g* Release end
21*h* Discharge hole
22 Clutch mechanism
23 Inlet pipe
24 Outlet pipe
24*a* Branching portion
24*b* First downcomer
24*c* Second downcomer
25 Rim water supply pipe (spout port water supply pipe)
25*a* Branching portion
25*b* Downcomer
26 Discharge valve float mechanism
26*a* Float portion
26*b* Engaging portion
30*a* Fixed flow valve
30*b* Vacuum breaker
31 Vacuum breaker
32 Water supply pipe
32*a* Stop cock
32*b* Fixed flow valve
33 Water supply pipe branching portion
33*a* First branching pipe
33*b* Second branching pipe
104 Flush water tank device
106 Remote controller
108 Grip ring (manual operation unit)
116 Manual valve opening mechanism
116*a* Movable member
116*b* Pilot valve body
116*c* Coil spring
116*d* Wire
117 Electromagnetic valve
117*a* Drive coil
117*b* Plunger
117*c* Pilot valve body
118 Discharge valve control valve (second on-off valve)
118*a* Control valve main body portion
118*b* Main valve body
118*c* Pilot valve port
118*d* Pressure chamber
119 Water supply control valve (first on-off valve)
119*a* Water supply valve main body portion
119*b* Main valve body
119*c* Pilot valve port
119*d* Pressure chamber
119*e* Pilot valve port during power outage
121 Delay valve opening mechanism.
121*a* Transmission arm member (second on-off valve driving mechanism)
121*b* Support portion
121*c* Water receiving portion
121*d* Balance float
121*e* Connecting portion
121*f* Pilot valve

What is claimed is:

1. A flush water tank device for supplying flush water to an upper spout port above a retained water surface in a flush toilet main body and a lower spout port below the retained water surface, the flush water tank device comprising:

a flush water tank main body;

a discharge valve that performs switching between ejection and stopping of the flush water from the lower spout port by performing switching between discharge and stopping of the flush water retained in the flush water tank main body;

a water pressure driving mechanism that drives the discharge valve with a water supply pressure of the flush water supplied from a water supply source;

a first on-off valve that performs switching between an ejection state and an ejection stopped state of the flush water, which has been supplied from the water supply source, from the upper spout port on the basis of a user's operation;

a second on-off valve that performs switching between water supply and stopping of the flush water, which has been supplied from the water supply source, to the water pressure driving mechanism; and a delay valve opening mechanism that causes the second on-off valve to open with a delay of predetermined time after water ejection from the upper spout port is started, using a part of the flush water introduced via the first on-off valve, to supply the flush water to the water pressure driving mechanism, wherein the delay valve opening mechanism includes a balance float that is disposed to receive a buoyant force from the flush water retained in the flush water tank main body, a water receiving portion that is configured such that a part of the flush water introduced via the first on-off valve flows into the water receiving portion, and a second on-off valve driving mechanism that is connected to the balance float and the water receiving portion, and wherein the second on-off valve driving mechanism causes the second on-off valve to open when the weight of the water receiving portion increases due to flowing-in of the flush water and overcomes the buoyant force acting on the balance float.

2. The flush water tank device according to claim 1, further comprising:

a spout port water supply pipe that is connected to a downstream side of the first on-off valve and communicates with the upper spout port, the spout port water supply pipe being provided with a branching portion, and the flush water that is branched by the branching portion flowing into the water receiving portion.

3. The flush water tank device according to claim 1, wherein the water receiving portion is provided with a discharge hole for discharging the flush water in the water receiving portion to inside of the flush water tank main body, the discharge hole allowing the flush water to be discharged at a lower flow rate than a flow rate of the flush water flowing into the water receiving portion.

4. The flush water tank device according to claim 1, wherein the water receiving portion is disposed above a water surface at a stopped water level of the flush water tank main body.

5. The flush water tank device according to claim 1, wherein the water receiving portion includes a connecting portion, the water receiving portion being connected to the balance float with a gap above the balance float by the connecting portion.

6. The flush water tank device according to claim 1, wherein the second on-off valve includes a diaphragm, a pressure chamber that presses the diaphragm, and a pilot valve that controls a pressure in the pressure chamber, and wherein the second on-off valve driving mechanism causes the pilot valve to open or close on the basis of a gravity acting on the water receiving portion and the buoyant force acting on the balance float.

7. A flush toilet apparatus comprising:

a flush toilet main body that includes the upper spout port above a retained water surface and the lower spout port below the retained water surface; and the flush water tank device according to claim 1 that supplies flush water to the upper spout port and the lower spout port.

* * * * *